US009656818B2

(12) United States Patent
Furuichi et al.

(10) Patent No.: US 9,656,818 B2
(45) Date of Patent: May 23, 2017

(54) PAPER FEEDING DEVICE AND IMAGE FORMING DEVICE INCLUDING PAPER FEEDING DEVICE

(71) Applicant: Konica Minolta, Inc., Chiyoda-ku, Tokyo (JP)

(72) Inventors: Wataru Furuichi, Hino (JP); Kazuyoshi Kimura, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/632,378

(22) Filed: Feb. 26, 2015

(65) Prior Publication Data

US 2015/0239692 A1 Aug. 27, 2015

(30) Foreign Application Priority Data

Feb. 27, 2014 (JP) ..... 2014-036497

(51) Int. Cl.
*B65H 31/26* (2006.01)
*B65H 3/54* (2006.01)
(Continued)

(52) U.S. Cl.
CPC ..... *B65H 3/54* (2013.01); *B65H 1/08* (2013.01); *B65H 1/14* (2013.01); *B65H 3/128* (2013.01);
(Continued)

(58) Field of Classification Search
CPC . B65H 1/04; B65H 3/04; B65H 3/045; B65H 3/047; B65H 3/08; B65H 3/0808;
(Continued)

(56) References Cited

U.S. PATENT DOCUMENTS 4,786,042 A * 11/1988 Stemmle ..... B65H 1/04 271/127
5,823,527 A * 10/1998 Burlew ..... B65H 1/14 271/147
(Continued)

FOREIGN PATENT DOCUMENTS

JP 2009113970 A 5/2009
JP 2010111510 A 5/2010

OTHER PUBLICATIONS

Japanese Notice of Reasons for Rejection corresponding to Application No. 2014-036497; Date of Mailing: Feb. 23, 2016, with English translation.

*Primary Examiner* — Prasad Gokhale
(74) *Attorney, Agent, or Firm* — Cantor Colburn LLP

(57) ABSTRACT

A paper feeding device of an image forming device includes a flotation air blowing unit and a separation air blowing unit. The flotation air blowing unit floats stacked uppermost paper through air blowing. The separation air blowing unit blows an end of other paper floated together with the floated uppermost paper to separate the other paper from the uppermost paper, the end being on the downstream side in the paper feeding direction. The flotation air blowing unit floats an end of the stacked uppermost paper, the end being on the downstream side in the paper feeding direction. The paper feeding device includes a resistance force applying mechanism which applies resistance force that gives a load against movement along the paper feeding direction to an end of stacked upper paper, the end being on the upstream side in the paper feeding direction.

17 Claims, 16 Drawing Sheets

(51) Int. Cl.

| | |
|---|---|
| ***B65H 1/14*** | (2006.01) |
| ***B65H 1/08*** | (2006.01) |
| ***B65H 3/12*** | (2006.01) |
| ***B65H 3/48*** | (2006.01) |

(52) U.S. Cl.
CPC ..... *B65H 3/48* (2013.01); *B65H 2404/563* (2013.01); *B65H 2405/13* (2013.01)

(58) Field of Classification Search
CPC ..... B65H 3/0816; B65H 3/0833; B65H 3/12; B65H 3/124; B65H 3/128; B65H 2405/114; B65H 2405/1142; B65H 2405/11425; B65H 2405/1144; B65H 2405/113; B65H 2405/13; B65H 2511/00; B65H 2511/10; B65H 2511/12; B65H 3/48; B65H 3/54; B65H 3/56; B65H 2406/12; B65H 2406/121; B65H 2406/1211; B65H 2406/122; B65H 2404/563
See application file for complete search history.

(56) References Cited

U.S. PATENT DOCUMENTS 5,893,554 A * 4/1999 Okahashi ..... B65H 3/128 271/104
2001/0017441 A1* 8/2001 Yamaguchi ..... B65H 3/128 271/94
2006/0012107 A1* 1/2006 Ueda ..... B65H 1/14 271/98
2008/0297580 A1* 12/2008 Fukumoto ..... B65H 3/60 347/104
2009/0206544 A1* 8/2009 Allwright ..... B65H 1/266 271/145
2010/0090392 A1* 4/2010 Ikeda ..... B65H 1/14 271/109
2011/0148027 A1* 6/2011 Fuda ..... B65H 1/04 271/15
2011/0221119 A1* 9/2011 Fuda ..... B65H 3/128 271/11
2012/0161384 A1* 6/2012 Suzuki ..... B65H 3/128 271/11
2012/0224902 A1* 9/2012 Chiwata ..... B65H 31/02 400/578
2013/0038016 A1* 2/2013 Inui ..... B65H 1/266 271/10.11
2013/0106045 A1* 5/2013 Okutsu ..... B65H 3/48 271/31
2013/0127108 A1* 5/2013 Shiraishi ..... B65H 1/14 271/11
2013/0214483 A1* 8/2013 Hirahara ..... B65H 1/00 271/264
2014/0131938 A1* 5/2014 Satoh ..... B65H 3/48 271/12
2015/0093172 A1* 4/2015 Supron ..... B41J 15/046 400/619
2015/0170349 A1* 6/2015 Mochizuki ..... B65H 1/00 382/133
2016/0107853 A1* 4/2016 Hashimoto ..... B65H 1/14 271/97

* cited by examiner

PAPER FEEDING DEVICE AND IMAGE FORMING DEVICE INCLUDING PAPER FEEDING DEVICE

CROSS REFERENCE

The present invention claims priority under 35 U.S.C. §119 to Japanese Application No. 2014-036497 filed Feb. 27, 2014, the entire content of which is incorporated herein by reference.

BACKGROUND OF THE INVENTION

Field of the Invention

The present invention relates to a paper feeding device and an image forming device including the paper feeding device.

Description of Related Art

An air-suction type paper feeding device has been known as a paper feeding device, which stocks paper of an image forming device in a stacked state and feeds the paper into an image forming unit.

As shown in FIG. 16, this air-suction type paper feeding device 200 includes flotation air blowing units 101, 102, a separation air blowing unit 103, a belt conveyance mechanism 105 (see FIG. 18), and a paper conveyance unit (for example, see U.S. Pat. No. 4,952,524). The flotation air blowing units 101, 102 blow air to the upper paper from both sides along the direction (hereinafter referred to as a width direction of the paper) perpendicular to the paper conveyance direction for the paper P (FIG. 16 shows index paper described below) stacked on a paper stacking unit, and float the paper P by sending air between pieces of the paper P. The separation air blowing unit 103 separates the uppermost paper P from the paper P floating with the uppermost paper P by blowing air from the downstream side in the paper conveyance direction of the uppermost paper. The belt conveyance mechanism. 105 is arranged above the stacked paper and feeds the paper P into the paper conveyance direction while sucking the paper P with a conveyance belt 104 (see FIG. 18) on which a suction hole is formed. The paper conveyance unit receives the paper P from the belt conveyance mechanism 105 and supplies the paper toward the further downstream side.

Then, when the paper is fed, the conveyance belt 104 stands by in a sucked state. The flotation air blowing units 101, 102 start blowing and float plural pieces of upper paper P. The separation air blowing unit 103 separates the uppermost paper P from the paper P other than the uppermost paper P. Then, the conveyance belt 104 is driven and only the uppermost paper P is fed into the conveying destination.

In the above-described conventional paper feeding device 200, the following problem has occurred when non-standard shape paper such as the index paper (or tab paper) is supplied.

In the index paper, a protruded index piece is formed on the edge of the paper, and positions of the index pieces in the longitudinal direction are different from each other so that the index pieces do not overlap. Thus, the index piece can be used as an index.

When the above-described index paper P is stocked, as shown in FIG. 16, the index piece P1 is set to face the upstream side in the conveyance direction so that the index piece P1 is not caught while being conveyed.

On the other hand, the width of a rear end regulating member 106, which aligns the end of the paper on the upstream side in the paper feeding direction, needs to be sufficiently narrower than the width of the index paper P so that the air flow from the separation air blowing unit 103, which is positioned on the downstream side in the paper feeding direction, is not disturbed. Therefore, when pieces of index paper P are stocked in a state where the positions of index pieces P1 are different, some of the index pieces P1 of the index paper P do not abut on the rear end regulating member 106.

In this state, when the plural pieces of upper index paper P are floated by air blowing from the flotation air blowing units 101, 102, and the separation of the uppermost index paper P is performed through air blowing from the separation air blowing unit 103, as shown in FIG. 17, sometimes the index paper P in which the index piece P1 does not abut on the rear end regulating member 106 is moved to the upstream side in the paper feeding direction by the separation air.

In this manner, some of the index paper P are shifted to the upstream side in the paper feeding direction. As shown in FIG. 18, when the index paper in which the shifting has occurred is supplied, the head portion of the index paper P right below the shifted index paper P is sucked by the conveyance belt 104. This causes double feed.

In order to solve this problem, it is considered to widen the width of the rear end regulating member 106 and form the rear end regulating member 106 in a comb-tooth shape, so that the separation air can pass through. However, there may be a problem that when the rear end regulating member 106 is formed in the comb-teeth shape with fine teeth, passing through of the separation air is blocked, and when formed in the comb-teeth shape with coarse teeth, the index piece P1 protrudes from a space between the teeth and the movement of the index paper P to the upstream side in the paper feeding direction cannot be prevented.

Although in the above example, a case where the positions of index pieces P1 of the index paper P are different in the width direction is exemplified, the following problem occurs also in a case where the index paper P in which the positions of index pieces P1 are the same is stacked.

That is, as shown in FIG. 19, when the position of the index piece P1 shifts relative to the rear end regulating member 106 and the index piece P1 does not abut on the rear end regulating member 106 with the sufficient width, as shown in FIG. 20, the index piece P1 of the index paper P, which has been separated by the separation air, is pushed to the upstream side in the paper feeding direction. Thus, sometimes the index piece P1 is damaged, or the index piece P1 is deformed and the index paper P is shifted to the upstream side in the paper feeding direction. As a result, similar to the example described above, it causes double feed.

SUMMARY OF THE INVENTION

An object of the present invention is to provide an image forming device and a paper feeding device thereof which appropriately supply non-standard shape paper such as index paper.

In order to achieve at least one of the objects, according to one aspect of the present invention, there is provided a paper feeding device of an image forming device including: a paper stacking plate on which paper is stacked; a lifting drive unit which lifts the paper stacking plate to a position where stacked uppermost paper is at a certain upper limit stop position; a flotation air blowing unit which floats the stacked uppermost paper through air blowing; a feeding mechanism which feeds the floated uppermost paper in the paper feeding direction; a separation air blowing unit which blows, toward the upstream side in the paper feeding direction, an end of other paper floated together with the floated uppermost paper to separate the other paper from the uppermost paper, the end being on the downstream side in the paper feeding direction; and a rear end regulating member which abuts on an end of the stacked paper to regulate a position of the end, the end being on the upstream side in the paper feeding direction, wherein the flotation air blowing unit floats an end of the stacked uppermost paper, the end being on the downstream side in the paper feeding direction, and wherein the paper feeding device of the image forming device includes a resistance force applying mechanism which applies resistance force that gives a load against movement along the paper feeding direction to an end of stacked upper paper, the end being on the upstream side in the paper feeding direction.

Preferably, in the paper feeding device, the resistance force applying mechanism applies pressure from above to the end of the stacked uppermost paper, the end being on the upstream side in the paper feeding direction.

Preferably, in the paper feeding device, the resistance force applying mechanism applies pressure to a certain range of the end of the stacked uppermost paper on the upstream side in the paper feeding direction, the certain range being a part in the paper width direction perpendicular to the paper feeding direction.

Preferably, in the paper feeding device, the resistance force applying mechanism applies pressure to portions of the end of the stacked uppermost paper on the upstream side in the paper feeding direction, the portions being opposite ends in the paper width direction.

Preferably, in the paper feeding device, the resistance force applying mechanism applies pressure to each of the opposite ends in the paper width direction in a range equal to or less than an eighth of a total width from each end of the paper.

Preferably, in the paper feeding device, the resistance force applying mechanism applies pressure to a certain range from the end of the paper on the upstream side in the paper feeding direction, the certain range being equal to or less than a fourth of a total length in the paper feeding direction.

Preferably, in the paper feeding device, the resistance force applying mechanism includes a pressurizing member, and the own weight of the pressurizing member applies pressure to the upper paper.

Preferably, in the paper feeding device, the resistance force applying mechanism includes an elastic member, and elastic force of the elastic member applies pressure to the upper paper.

Preferably, in the paper feeding device, the resistance force applying mechanism includes a flexible member which contacts with the uppermost paper, flexibility of the flexible member applies pressure to the uppermost paper.

Preferably, in the paper feeding device, the resistance force applying mechanism applies the resistance force when the uppermost paper is at the upper limit stop position.

Preferably, the paper feeding device includes a pair of side edge regulating members which abuts on opposite ends of the stacked paper in the paper width direction perpendicular to the paper feeding direction and regulates positions of the ends, and the resistance force applying mechanism is individually and detachably provided on each of the pair of side edge regulating members.

Preferably, in the paper feeding device, the resistance force applying mechanism includes an inclined surface which guides the end of the paper on the upstream side in the paper feeding direction such that the end of the paper does not bend in relation to the paper feeding direction.

According to a second aspect of the present invention, there is provided an image forming device which includes the above paper feeding device.

Preferably, the image forming device further includes a control unit which executes specific control for using index paper as the paper. The resistance force applying mechanism includes an actuator which switches between an operation state in which the resistance force is applied to the end of the stacked upper paper on the upstream side in the paper feeding direction, and a non-operation state in which the resistance force is not applied. The control unit controls the actuator such that, when the specific control is executed, the resistance force applying mechanism is in the operation state.

BRIEF DESCRIPTION OF THE DRAWING

The present invention will become more fully understood from the detailed description given hereinbelow and the appended drawings which are given by way of illustration only, and thus are not intended as a definition of the limits of the present invention, and wherein.

DESCRIPTION OF EMBODIMENT

Summary of Image Forming Device

Hereinafter, an embodiment of the present invention will be described with reference to the drawings. Though various technical limitations which are preferable to perform the present invention are included in the after-mentioned embodiment, the scope of the invention is not limited to the following embodiment and the illustrated examples.

Figure 1:
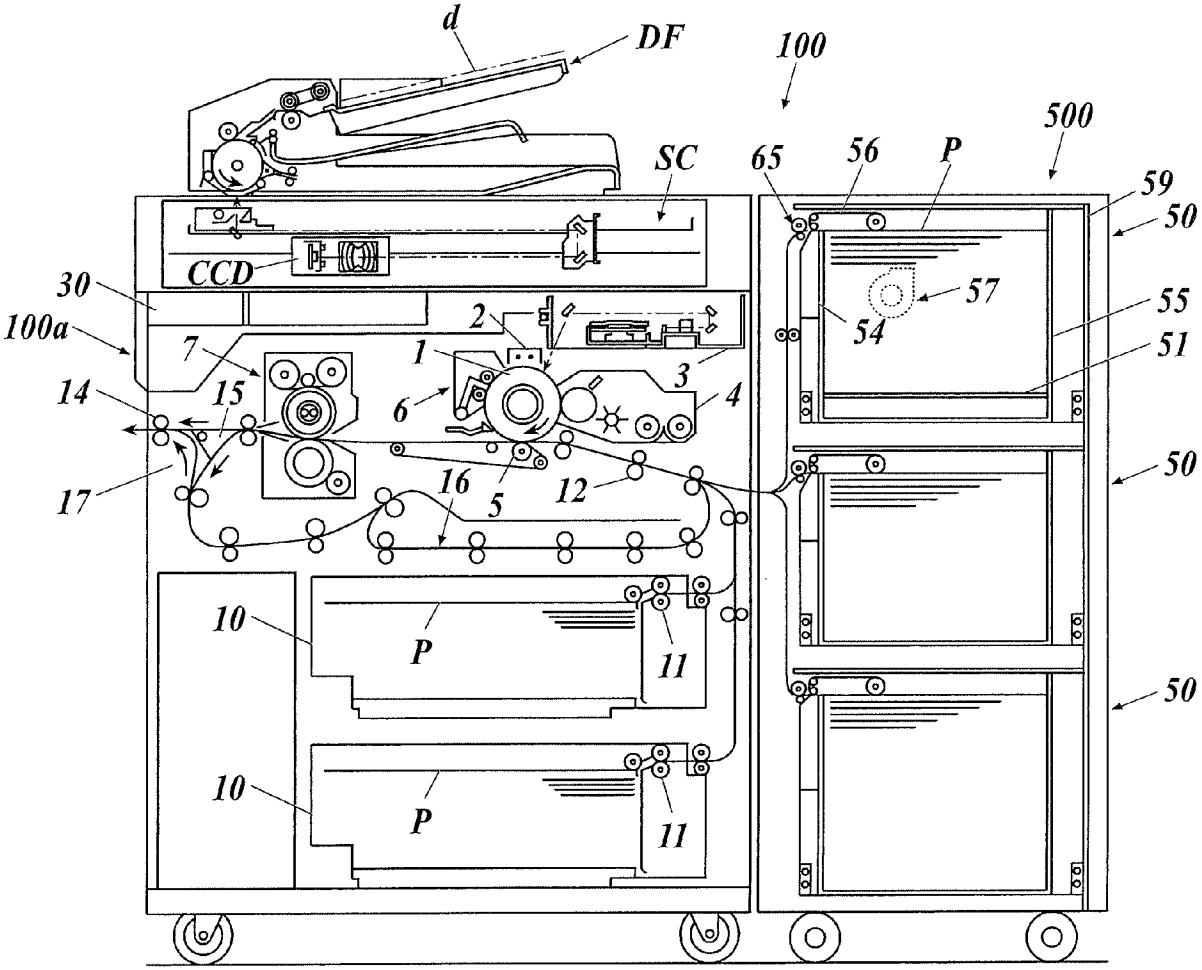
FIG. 1 is a whole configuration view showing an image forming device according to the present invention.

FIG. 1 is a whole configuration view of an image forming device 100 according to the present invention.

As shown in FIG. 1, the image forming device 100 mainly includes an image forming device body 100*a*, an image reading device SC, an automatic document feeder DF, an image processing unit 30, and a paper feeding device 500.

The image forming device body 100*a* includes an image forming unit which has a photoreceptor 1, a charging unit 2, an image exposure unit 3, a developing unit 4, a transfer unit 5, a cleaning unit 6 and so on, a fixing unit 7, and a paper conveyance system.

The paper conveyance system includes a paper feeding cassette 10, a first paper feeding unit 11, a second paper feeding unit 12, a paper ejecting unit 14, a conveyance path switching unit 15, a circulation paper re-feeding unit 16 and a reverse paper ejection unit 17.

The paper feeding device 500 includes three paper feeding units 50 which are arranged vertically.

Automatic Document Feeder and Image Reading Device

The document "d" placed on a document table of the automatic document feeder DF is conveyed by a paper feeding unit. Then, a single-sided or double-sided images of the document "d" are read by an optical system of the image reading device SC and read by an image sensor CCD. In the image processing unit 30, analog processing, A/D conversion, shading correction, image compression processing and so on are performed on an analog signal, which has been photoelectrically converted by the image sensor CCD. Then, the analog signal is transmitted as an image signal to the image exposure unit 3.

A control device of the image forming device 100 (not shown) is communicable with an external device (for example, a personal computer) connected to a communication network from a communication unit (not shown), and sometimes transmits the image signal received from the external device to the image exposure unit 3 through the image processing unit 30.

Image Forming Unit

In the image forming unit, a charge is added to the photoreceptor 1 by the charging unit 2, and an electrostatic latent image is formed by laser light irradiation from the image exposure unit 3. Then, the electrostatic latent image is visualized by the developing unit 4 and becomes a toner image. After that, paper P stored in the paper feeding cassette 10 is conveyed from the first paper feeding unit 11. The paper P is synchronized with the toner image at the second paper feeding unit 12 including a registration roller and conveyed. Thereafter, the toner image is transferred to the paper P at the transfer unit 5 and fixed by the fixing unit 7.

Not only the paper P stored in the paper feeding cassette 10 but also paper P stored in the paper feeding device 500 is fed to the image forming device body 100*a*, and the toner image is transferred to the paper P and fixed.

The paper P on which the toner image is fixed is ejected outside the device by the paper ejecting unit 14. On the other hand, transfer residual toner on the photoreceptor 1 is removed by the cleaning unit 6. In double-sided printing, the paper P on which the image is formed on a first surface is fed into the circulation paper re-feeding unit 16 by the conveyance path switching unit 15 and is reversed. Then, the image is formed on a second surface again by the image forming unit, and the paper P is ejected outside the device by the paper ejecting unit 14. In reverse paper ejecting, the paper P that branches from the normal paper ejecting passage moves backward and is reversed upside down at the reverse paper ejection unit 17. Then the paper P is ejected to the outside of the device by the paper ejecting unit 14.

Summary of Paper Feeding Device

Figure 2:
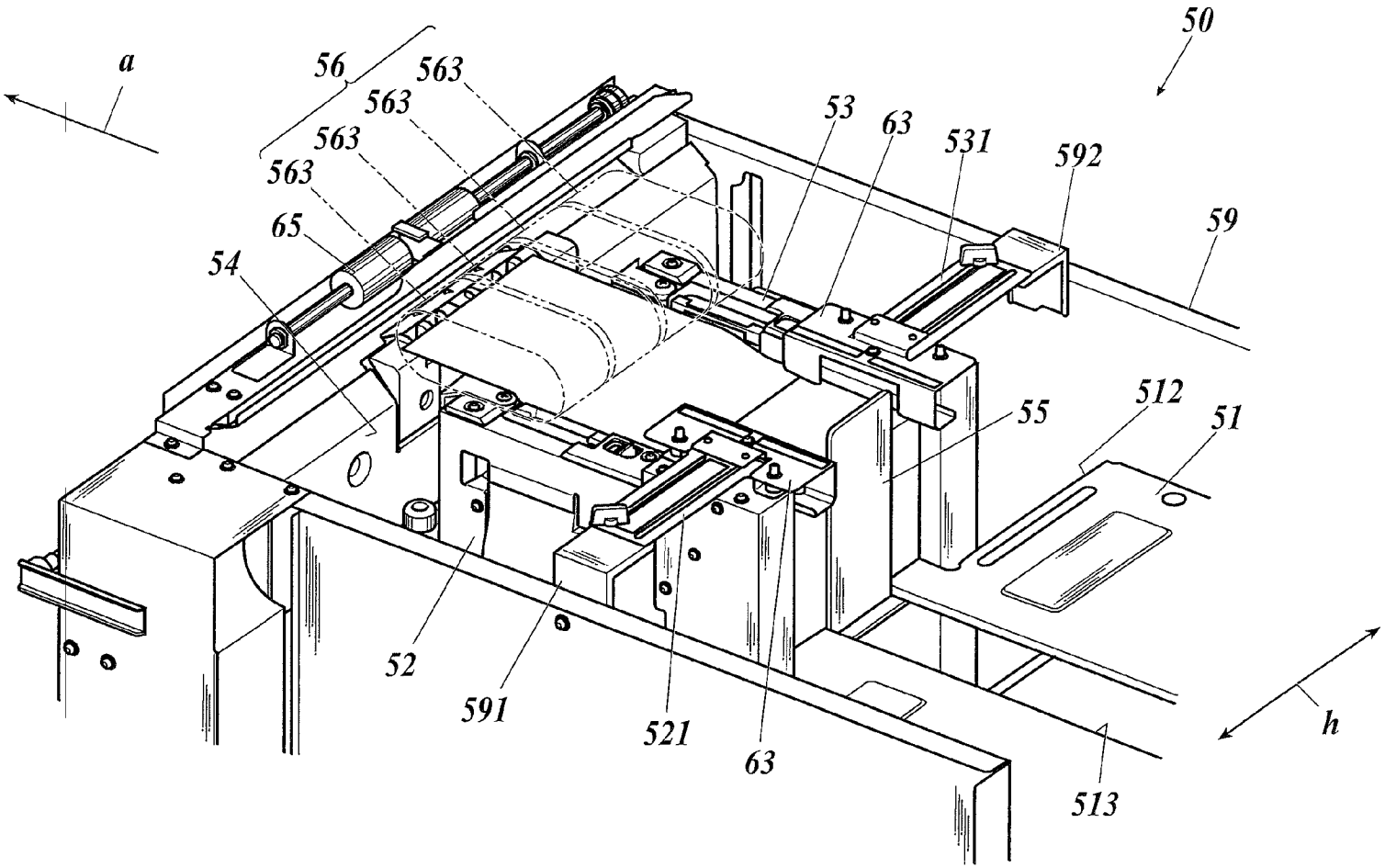
FIG. 2 is a perspective view of a paper feeding unit of the image forming device.
Figure 3:
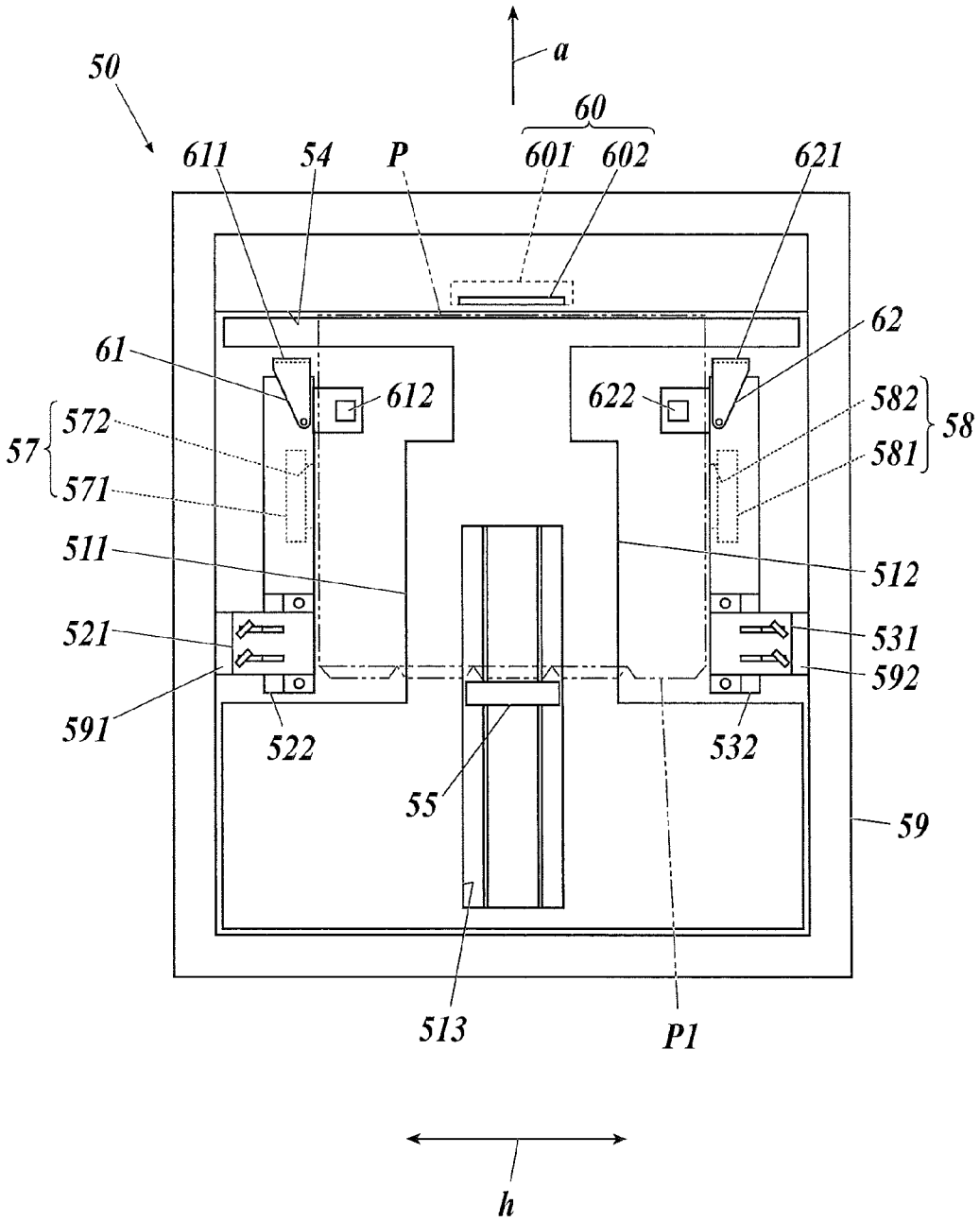
FIG. 3 is a plan view of the paper feeding unit of the image forming device.
Figure 4:
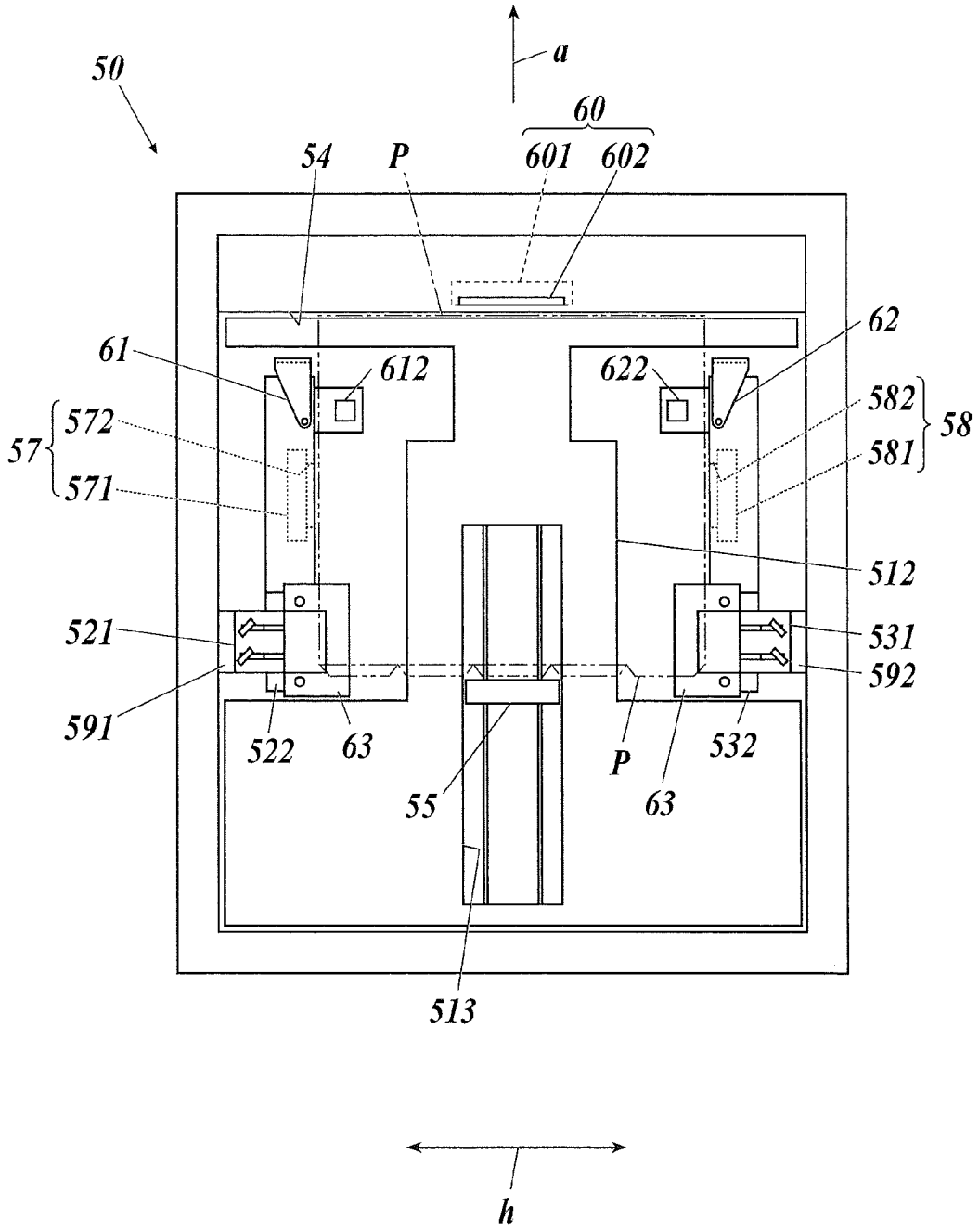
FIG. 4 is a plan view in a state where a resistance force applying mechanism is used in the paper feeding unit of the image forming device.

FIG. 2 is a perspective view showing an outline of the paper feeding units 50 of the paper feeding device 500. FIG. 3 is a plan view. FIG. 4 is a plan view in a state where a resistance force applying mechanism 63 described below is used. As described above, the three paper feeding units 50 are arranged vertically in the paper feeding device 500. Since these paper feeding units 50 have the same configuration, one of these paper feeding units 50 will be described here.

In the description below, the front side of the paper feeding unit 50 in the paper feeding direction "a" will be referred to as "downstream side", while the opposite side will be referred to as "upstream side".

The paper feeding unit 50 includes a paper stacking plate 51, a lifting motor (illustration omitted) as a lifting drive unit, a pair of side edge regulating members 52, 53, a front end regulating member 54, a rear end regulating member 55, auxiliary side edge regulating members 61, 62, two resistance force applying mechanisms 63, 63, a housing 59, and a paper feeding belt mechanism 56 as a feeding mechanism. The paper stacking plate 51 places the paper P in a stacked state. The lifting motor lifts the paper stacking plate 51 such that the uppermost paper P in the stacked state is lifted to a certain upper limit stop position "m" (see FIG. 10). The side edge regulating members 52, 53 are movable in the width direction of the paper (hereinafter referred to as paper width direction "h"), which is horizontal and perpendicular to the paper feeding direction "a" of the paper P, and regulates positions of both ends of the paper P in the paper width direction "h" to predetermined positions. The front end regulating member 54 regulates the position of an end of the paper P to a predetermined position, the end being on the downstream side in the paper feeding direction "a". The rear end regulating member 55 regulates the position of an end of the paper P to a predetermined position, the end being on the upstream side in the paper feeding direction "a". The auxiliary side edge regulating members 61, 62 regulate positions of both ends in the paper width direction "h" to predetermined positions for the paper that has a width narrower than the minimum regulation width of the side edge regulating members 52, 53. The resistance force applying mechanisms 63, 63 apply resistance force that gives a load against movement along the paper feeding direction "a" to the end of the upper paper P stacked on the paper stacking plate 51 to an extent in which feeding of the feeding mechanism 56 is not disturbed, the end being on the upstream side in the paper feeding direction "a". The housing 59 stores the paper P and each configuration described above. The paper feeding belt mechanism 56 sucks the paper and feeds it into the paper feeding direction above the housing 59.

The "upper paper" includes at least the uppermost paper and the next paper.

The housing 59 is a rectangular parallelepiped box with an open top.

The above-described paper stacking plate 51 is a rectangular flat plate, and notches 511, 512 are formed at side edges of both ends in the paper width direction "h" in the vicinity of the end on the downstream side in the paper feeding direction "a". The notches 511, 512 are provided for avoiding interference with the side edge regulating members 52, 53 which are moved in the paper width direction "h" for adjustment. In addition, from the vicinity of the end of this paper stacking plate 51 on the upstream side in the paper feeding direction "a" toward the downstream side, a rectangular opening 513 is formed at the central part in the paper width direction "h". The rear end regulating member 55 which is mounted on the inner bottom surface of the housing 59 extends above through the opening 513.

The paper stacking plate 51 is supported inside the housing 59 by the housing 59 such that the paper stacking plate 51 can move vertically, and vertical movement is provided by the lifting motor through a vertical movement mechanism not shown. The vertical movement mechanism is a mechanism which converts a torque from the lifting motor into linear movement along the vertical direction. For example, a pinion rack mechanism or a ball screw mechanism is used.

Above the paper stacking plate 51, an upper limit sensor (illustration omitted) is provided. The limit sensor detects that the stacked uppermost paper P is lifted to a predetermined upper limit stop position "m". The control device of the image forming device 100 controls the lifting motor such that the stacked uppermost paper P is always maintained at the upper limit stop position "m". When there is no paper P, the lifting motor is controlled such that the upper surface of the paper stacking plate 51 is at the upper limit stop position "m".

The rear end regulating member 55 is mounted on the inner bottom surface of the housing 59 in a state where the flat plate of the rear end regulating member 55 surface is directed perpendicular to the paper feeding direction "a" such that the position can be adjusted along the paper feeding direction "a". The upper end of the rear end regulating member 55 is higher than the above-described upper limit stop position "m", and the flat plate abuts on the end of the stacked paper P on the upstream side in the paper feeding direction "a" to regulate the end position on the upstream side to the predetermined position.

The position of the rear end regulating member 55 can be manually adjusted along the paper feeding direction "a" in a range of the opening 513 of the paper stacking plate 51. The end position of the paper P on the upstream side in the paper feeding direction "a" can be adjusted if necessary.

The pair of side edge regulating members 52, 53 is arranged on opposite sides in the width direction across the central part of the paper stacking plate 51. The side edge regulating members 52, 53 are erected on the inner bottom surface of the housing 59 such that the inner side surfaces of the side edge regulating members 52, 53 opposing to each other are along the vertical direction and the paper feeding direction "a", and can move along the paper width direction "h" for adjustment. The inner side surfaces of the side edge regulating members 52, 53, which oppose to each other, respectively abut on the edges of the stacked paper P in the paper width direction "h" to regulate the edges to the predetermined position.

The side edge regulating members 52, 53 are coupled with the other by an interlocking mechanism such that, when one is moved in the paper width direction "h" for adjustment, the other is moved in the opposite direction by the same distance. Each of the side edge regulating members 52, 53 maintains the same distance from the center line of the paper stacking plate 51 in the paper width direction "h". For example, a common configuration with long members can be used as the interlocking mechanism. The long members protrude toward each other along the paper width direction "h" on the bottom of the side edge regulating members 52, 53. Rack teeth are formed on the side edges of the long members which oppose to each other. A pinion gear which engages with both rack teeth is provided.

On the inner side surfaces of the housing 59, supporting plates 591, 92 which protrude toward the side edge regulating members 52, 53 are fixed. On the upper end surfaces of the side edge regulating members 52, 53 on the upstream side in the paper feeding direction "a", guide plates 521, 531 which protrude toward the supporting plates 591, 592 are mounted.

Each of the guide plates 521, 531 is provided with a pair of elongate holes along the protruding direction of each of the guide plates 521, 531. The guide plates 521, 531 are respectively coupled to the supporting plates 591, 592 through butterfly screws. When the position of the side edge regulating member 52, 53 is adjusted, coupling of the supporting plate 591, 592 with the guide plate 521, 531 is released by loosening the butterfly screw. Then, after the position is adjusted, the butterfly screw is fastened again along the elongate holes, and the position in the paper width direction "h" after adjusting the side edge regulating member 52, 53 is fixed.

At the ends of the side edge regulating members 52, 53 on the upstream side in the paper feeding direction "a", step portions 522, 532 which are higher than other portions are formed. The guide plates 521, 531 are mounted on the step portions 522, 532.

Each of the side edge regulating members 52, 53 is a hollow box, and flotation air blowing units 57, 58 are respectively stored inside the side edge regulating members 52, 53. These flotation air blowing units 57, 58 respectively include ducts 571, 581 each of which incorporates a fan, and can float the uppermost paper P by blowing air from both sides in the paper width direction "h" toward the uppermost paper P from air blowing ports 572, 582 which are respectively provided at the upper limit stop position "m" in the inner side surface of the side edge regulating members 52, 53.

The front end regulating member 54 is fixedly mounted on the downstream side of the side edge regulating members 52, 53 in the paper feeding direction "a" on the inner bottom surface of the housing 59 in a state where the flat plate surface of the front end regulating member 54 is perpendicular to the paper feeding direction "a". The flat surface of the front end regulating member 54 on the upstream side in the paper feeding direction "a", which opposes to the end of each of the side edge regulating members 52, 53 on the downstream side in the paper feeding direction "a", abuts on the end of the stacked paper P on the downstream side in the paper feeding direction "a" to regulate the end to the predetermined position.

Moreover, the front end regulating member 54 is a hollow box, and a separation air blowing unit 60 is stored inside the front end regulating member 54. The separation air blowing unit 60 blows air so that the underside paper P, which floats with the uppermost paper P through air blowing of the above-described flotation air blowing units 57, 58, is removed.

The separation air blowing unit 60 includes a duct 601 which incorporates a fan and blows air from an air blowing port 602 on the upper surface of the front end regulating member 54 toward the paper P at the underside of the floated uppermost paper P from the downstream side in the paper feeding direction "a" to remove the underside paper.

In addition, this separation air blowing unit 60 includes a wind direction switching plate and an actuator (not shown) in the duct 601. When the paper P is floated, the separation air blowing unit 60, together with the flotation air blowing units 57, 58, blows air obliquely downward to float the end of the paper P on the downstream side in the paper feeding direction "a". After the paper P is floated, the separation air blowing unit 60 blows air obliquely upward so that the uppermost paper P and the paper P below the uppermost paper P are separated.

Figure 5:
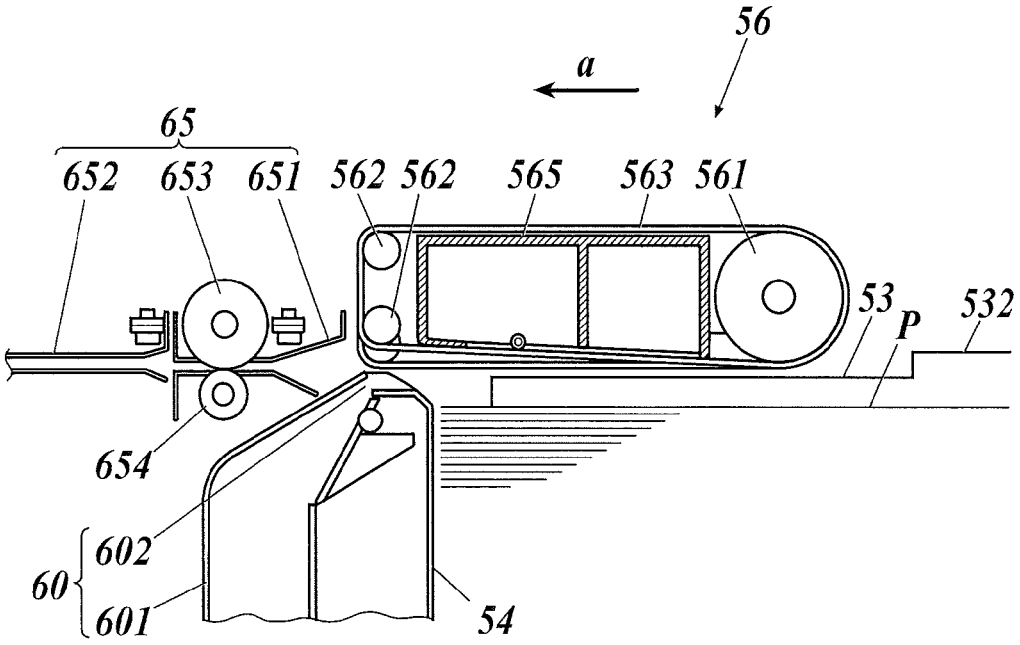
FIG. 5 is a side view of a paper feeding belt mechanism of the paper feeding unit.

In the paper feeding unit 50, as shown in FIG. 5, the paper feeding belt mechanism 56 is arranged above the ends of the side edge regulating members 52, 53 on the downstream side in the paper feeding direction "a" (illustration of the side edge regulating member 52 omitted in FIG. 5) and above the front end regulating member 54.

This paper feeding belt mechanism 56 includes a large-diameter roller 561, two small-diameter rollers 562, 562, four sets of belts 563, a paper feeding motor (illustration omitted), a duct 565, and a fan (illustration omitted). The large-diameter roller 561 is provided on the upstream side in the paper feeding direction "a". The two small-diameter rollers 562, 562 are provided on the downstream side in the paper feeding direction "a". The four sets of belts 563 are stretched by the roller 561 and the rollers 562, 562 and are arranged in the paper width direction. The paper feeding motor rotationally drives the roller 561. The duct 565 is inserted into inside of each belt 563. The fan makes pressure in the duct 565 negative at the other ends of the duct 565. A sprocket may be used instead of the rollers 561, 562.

In each belt 563, a plurality of small holes that penetrates from the front to the rear is formed over the whole surface. The pressure inside the duct 565 arranged inside is made negative by the fan so that it is possible to suck the paper P on the lower part of each belt 563 through the small holes.

The lower part of the belt 563, which sucks the paper P, is higher than the upper limit stop position "m", and is close to and opposite to the upper surface (excluding the step portion 522, 532) of the side edge regulating member 52, 53.

The lower part of each belt 563 is conveyed to the paper feeding direction "a" by the drive of the paper feeding motor, and the sucked paper P can be fed in the paper feeding direction "a".

A conveyance unit 65 is provided on the downstream side of the paper feeding belt mechanism 56 in the paper feeding direction "a". This conveyance unit 65 includes an insertion guide unit 651, conveyance rollers 653, 654, and a motor (illustration omitted) as a driving source. The insertion guide unit 651 can insert the paper P fed from the lower part of the belt 563. The conveyance rollers 653, 654 sandwich the paper P on the downstream side of the insertion guide unit 651 in the paper feeding direction "a" and feed the paper P into a conveyance path 652 which extends to the conveyance path of the image forming device body 100*a*. The motor rotationally drives the conveyance rollers 653, 654.

The auxiliary side edge regulating members 61, 62 are turnably supported around an axis along the vertical direction at the end of each of the side edge regulating members 52, 53 on the downstream side in the paper feeding direction "a". When not in use, as shown in FIGS. 3 and 4, the regulation surfaces 611, 621 face to the downstream side in the paper feeding direction "a". When in use, the auxiliary side edge regulating members 61, 62 are turned inside by 90° and the regulation surfaces 611, 621 face inside and are opposed to each other. In such a state where the auxiliary side edge regulating members 61, 62 are used, the regulation surfaces 611, 621 abuts on the side end of the paper P, which is narrower than the minimum regulation width of the side edge regulating members 52, 53, and regulates the position of each end of the paper P in the width direction to the predetermined position.

Reference numerals 612, 622 in FIGS. 3 and 4 indicate sensors which detect that the auxiliary side edge regulating members 61, 62 are switched to a use state and which inform the control device of the switching. Such sensors may be an optical type, a contact type, or any other types.

Figure 6:
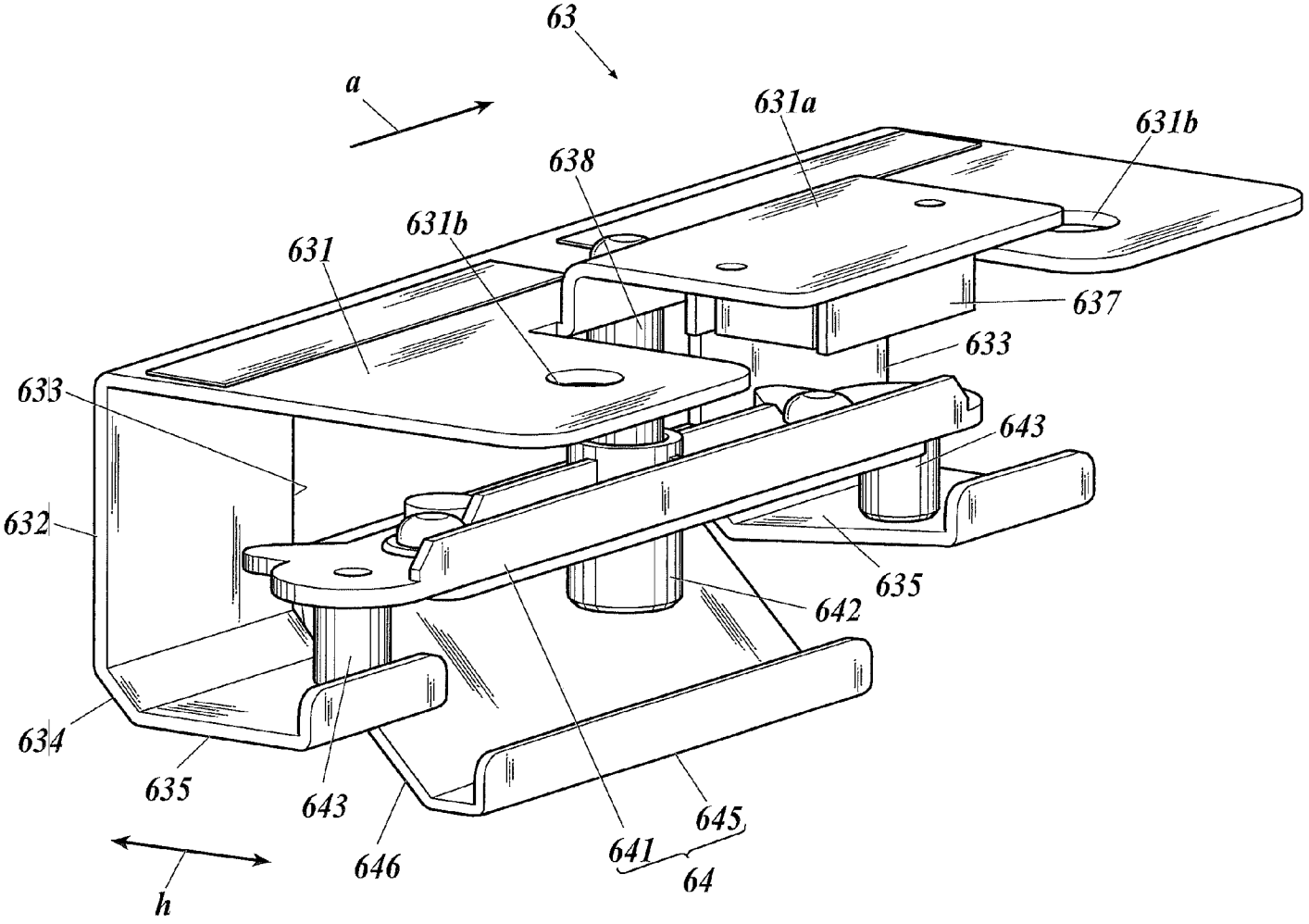
FIG. 6 is a perspective view of the resistance force applying mechanism.
Figure 7:
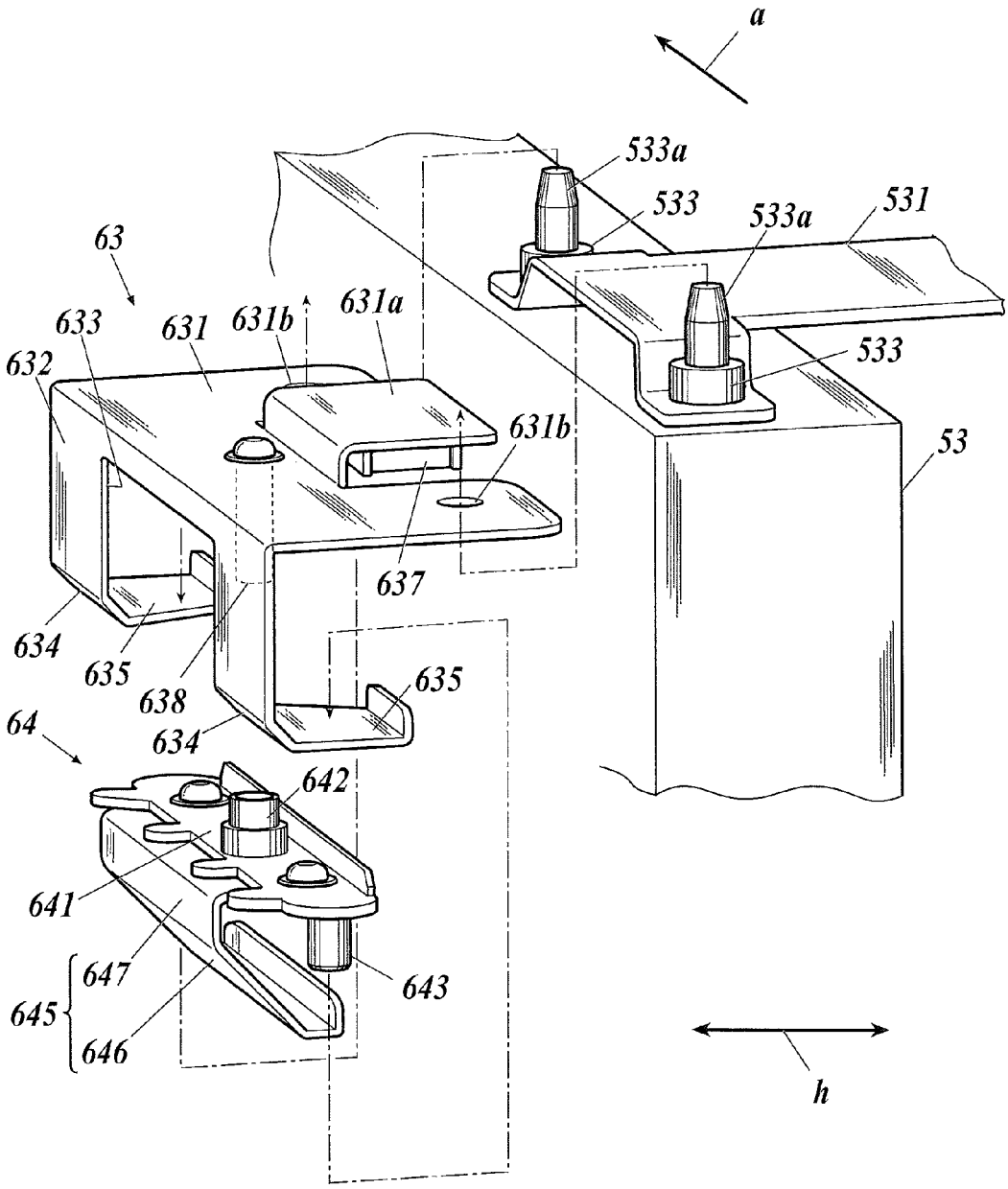
FIG. 7 is an exploded perspective view of the resistance force applying mechanism.

The resistance force applying mechanisms 63, 63 will be described with reference to FIGS. 6 to 8. Since the resistance force applying mechanisms 63, 63 which are respectively mounted on the side edge regulating members 52, 53 have the same structure, only the case in which the resistance force applying mechanism 63 is mounted on the side edge regulating member 53 side will be described. Description of the case in which the resistance force applying mechanism 63 is mounted on the side edge regulating member 52 is omitted.

The resistance force applying mechanism 63 is attached to the side edge regulating member 53 through engagement protrusions 533*a*, 533*a* provided at the upper end of two screws 533, 533 that fix the tip of the guide plate 531 to the upper surface of the side edge regulating member 53. The resistance force applying mechanism 63 includes an upper surface portion 631, aside surface portion 632, two inclined portions 634, 634, supporting portions 635, 635, a magnet 637, a cylindrical support 638 and a load member 64. The upper surface portion 631 is horizontal when attached. The side surface portion 632 is connected to one end (end which is on the opposite side of the side edge regulating member 53) of the upper surface portion 631 and is bent downward. The two inclined portions 634, 634 are connected to the lower end which is made bifurcated by a notch 633 formed on the side surface portion 632, and include an inclined surface. The supporting portions 635, 635 are made horizontal by folding back to the side edge regulating member 53 side from each of inclined portions 634, 634. The magnet 637 fixes the resistance force applying mechanism 63 to the side edge regulating member 53. The support 638 supports the load member 64 described below.

A step portion 631*a* which is higher than others is formed at the central part of the end of the upper surface portion 631 of the resistance force applying mechanism 63 on the side of the side edge regulating member 53, the central part being the center in the paper feeding direction "a". The magnet 637 is fixedly mounted on the backside of the step portion 631*a*.

Then, at the both sides sandwiching the step portion 631*a*, through holes 631*b*, 631*b* which penetrate vertically are formed. By respectively inserting the engagement protrusions 533*a*, 533*a* of the screws 533, 533 into these through holes 631*b*, 631*b*, the resistance force applying mechanism 63 is attached to the side edge regulating member 53.

The magnet 637 provided on the upper surface portion 631 attracts and fixes the resistance force applying mechanism 63 to the guide plate 531 made of a magnetic material. In this manner, the resistance force applying mechanism 63 is detachable since it is fixed by the magnet 637. When not in use, the resistance force applying mechanism 63 is easily released from a fixed state and can be detached from the side edge regulating member 53.

The lower end of each of the inclined portions 634, 634 are continued to each of the supporting portions 635, 635. The upper surfaces of these supporting portions 635, 635 are horizontal. The resistance force applying mechanism 63 supports the load member 64 which includes boss portions 643, 643 respectively placed on the upper surfaces. Thus the upper surfaces regulate the lower limit position of the vertical moving range of the load member 64.

Figure 10:
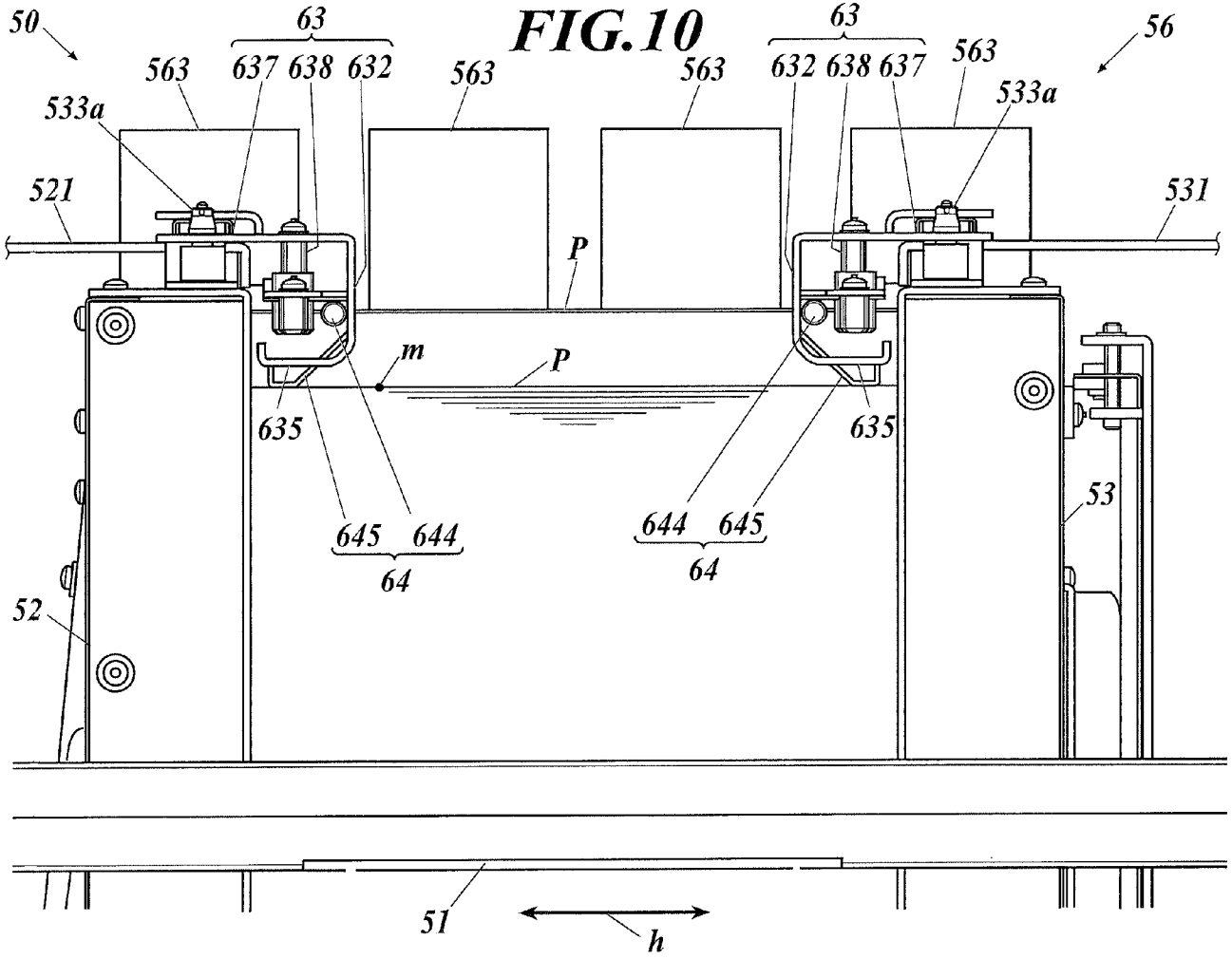
FIG. 10 is a view seen from the upstream side in the paper feeding direction showing a state in which the load member gives the paper a load in a state where plural pieces of paper are stacked on the paper stacking plate.

The lower surface of the supporting portions 635, 635, which is the lower end of the resistance force applying mechanism 63, is positioned somewhat higher than the above-described upper limit stop position "m" as shown in FIG. 10.

The resistance force applying mechanism 63, at its lower part, supports the load member 64 which applies resistance force that gives a load against movement of the paper P along the paper feeding direction.

This load member 64 is supported by the resistance force applying mechanism 63 such that the load member 64 can move vertically.

The load member 64 functions as a pressurizing member, and includes a base portion 641 and an inclined member 645. The base portion 641 is supported such that the base portion 641 can move vertically relative to the resistance force applying mechanism 63. The inclined member 645 has an inclined portion 646 which is fixedly mounted on the lower part of the base portion 641.

The base portion 641 is an elongate flat plate along the paper feeding direction "a", and includes a cylindrical portion 642 which vertically penetrates the central part of the base portion 641, the central part being the center in the paper feeding direction "a". The above-described support 638 of the resistance force applying mechanism 63 is inserted into the cylindrical portion 642. The cylindrical portion 642 is supported such that the load member 64 vertically moves along the support 638.

In addition, the cylindrical boss portions 643, 643 are fixedly mounted in a downwardly hanging state on the lower surface of both ends of the base portion 641 in the paper feeding direction "a". The lower ends of these boss portions 643, 643 abut on the respective supporting portions 635, 635 of the above-described resistance force applying mechanism 63. Thereby the lower limit position of the vertical moving range of the load member 64 relative to the resistance force applying mechanism 63 is determined.

Figure 8:
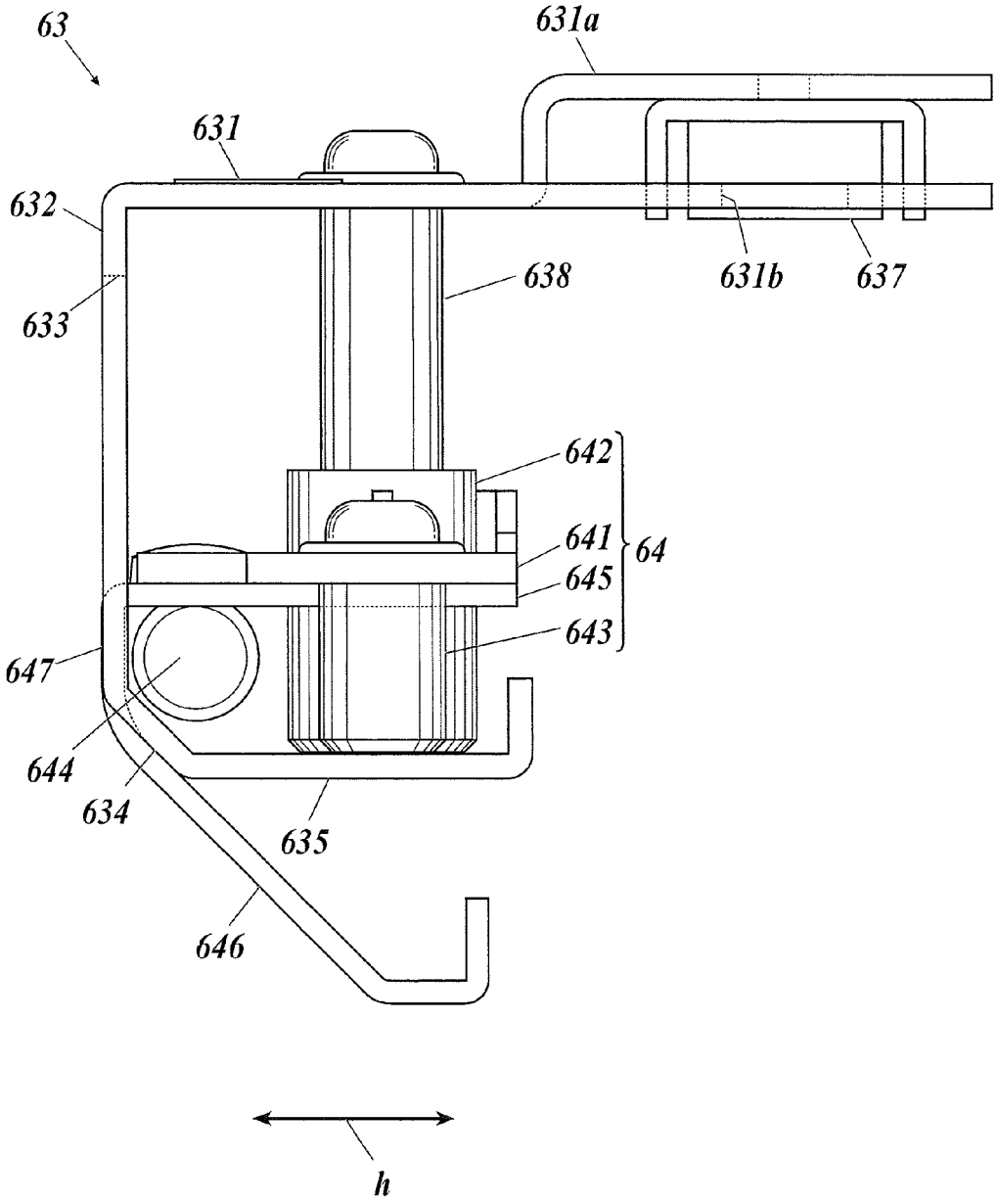
FIG. 8 is a rear view of the resistance force applying mechanism in a state where a load member is hanged.

In a state where the lower part of the inclined member 645 is not in contact with anything, the load member 64 remains at the lower limit position regulated by the boss portions 643, 643 (state in FIG. 8). This is due to its own weight and is also due to the supporting structure of the base portion 641. The load member 64 can be easily moved upward by applying upward external force to the load member 64 (state in FIG. 9).

Figure 9:
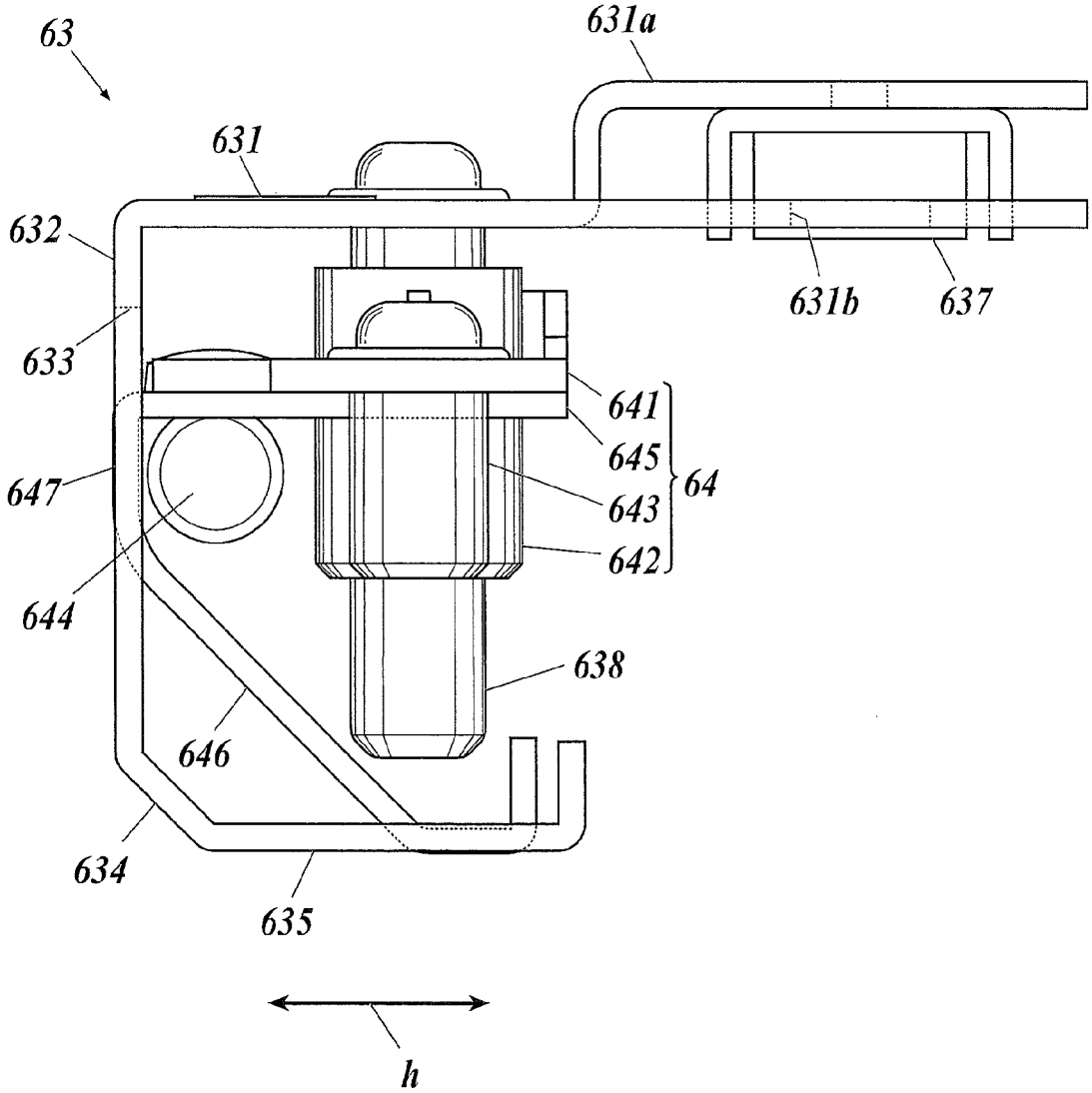
FIG. 9 is a rear view of the resistance force applying mechanism in a state where the load member is lifted.

FIG. 9 shows a case where the load member 64 is configured such that the bottom of the inclined member 645 comes to the same height as the bottom of the supporting portion 635 when the load member 64 is at the upper limit position. In this case, when the load member 64 is at the lower limit position, the bottom of the inclined member 645 is lower than the upper limit stop position "m". When the load member 64 is at the upper limit position, the bottom of the inclined member 645 is higher than the upper limit stop position "m".

That is to say, when the uppermost paper P is at the upper limit stop position "m", the bottom of the inclined member 645 abuts on the upper surface of the paper P and the whole load member 64 is pushed up. As a result, the load member 64 contacts with the upper surface of the paper P with contacting pressure according to the whole weight, and causes friction against the paper P to generate a load, the paper P moving along the paper feeding direction "a".

This intends to prevent movement of the paper P to the upstream side in the paper feeding direction "a" using the load of the load member 64 when index paper P is stacked on the paper stacking plate 51 as the paper P, the movement being made by separation air from the separation air blowing unit 60.

Figure 11:
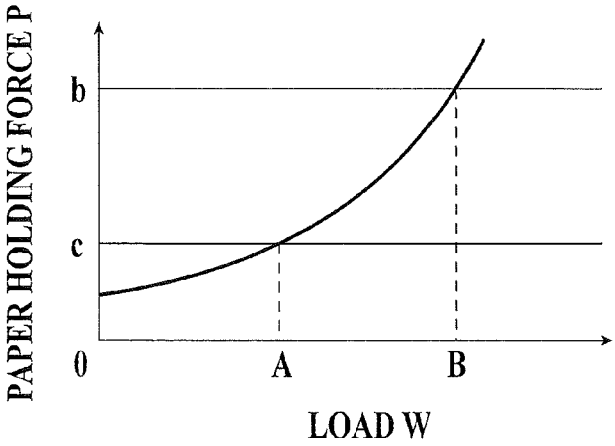
FIG. 11 is a diagram showing a relation between paper holding force and a load.

FIG. 11 shows the relation between a paper holding force and a load. When a paper holding force is no more than the value "c", the paper P is moved to the upstream side in the paper feeding direction "a" by the separation air. When a paper holding force reaches the value "b", the belt 563 of the paper feeding belt mechanism 56 cannot suck and feed the paper P.

It is desirable that a numerical value range of a load W of the load member 64 is $A<W<B$. "A" is a value of a load corresponding to the value "c" of the paper holding force. "B" is a value of a load corresponding to the value "b" of the paper holding force.

The load of the load member 64 can be suitably adjusted according to the weight of a weight 644 shown in FIGS. 8 and 9. Therefore, the weight of the weight 644 is selected in consideration of the whole weight of the two load members 64 which are provided at both sides in the paper width direction "h" such that the load W of the load member 64 is within the range $A<W<B$.

It is desirable that the weight of the weight 644 is able to be adjusted by replacing, adding, reducing, etc. the weight.

Figure 12:
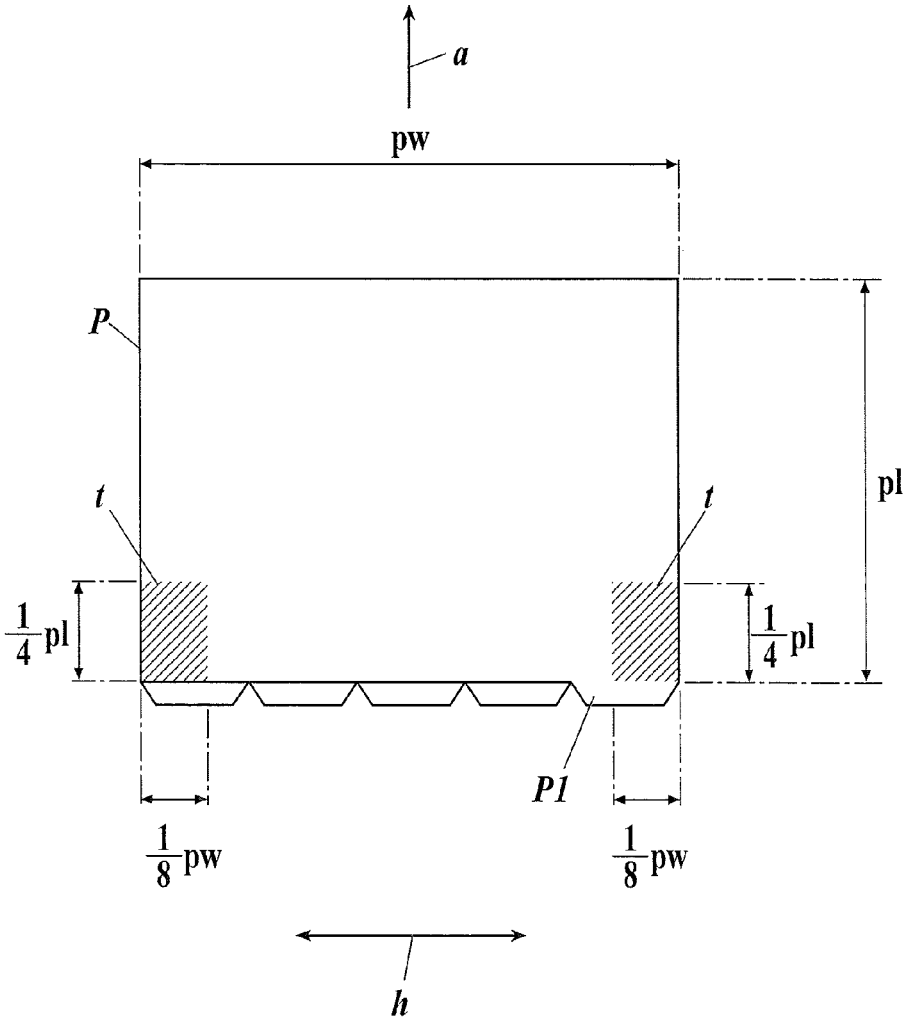
FIG. 12 is an explanatory plan view showing an appropriate contact range of the two load members for index paper.

FIG. 12 is an explanatory plan view showing an appropriate contact range "t" of the two load members 64 against the paper P as the index paper.

In the figure, the length of the paper P, which is the index paper, in the paper feeding direction "a" is "pl" while the width in the paper width direction "h" is "pw". Each load member 64 is arranged to contact with the paper P within a range which is $(1/8)\cdot pw$ or less from each of both ends of the paper P in the paper width direction "h" and which is $(1/4)\cdot pl$ or less from the end of the paper P on the upstream side in the paper feeding direction "a". It is assumed that this numeral value range is a range not including the portion of an index piece P1 of the index paper.

In this manner, the contact range "t" of the load member 64 is set to be $(1/8)\cdot pw$ or less from each of the both ends of the paper P in the paper width direction "h". As a result, when the separation air is blown toward the upstream side from the end of the uppermost paper P and the paper P below the uppermost paper P on the downstream side in the paper feeding direction "a", the separation air passes between the load members 64 so that favorable separation is performed.

In addition, the contact range "t" of each load member 64 is $(1/4)\cdot pl$ or less from the end of the paper P on the upstream side in the paper feeding direction "a". As a result, floating by the flotation air at the side of the end of the paper P on the downstream side in the paper feeding direction "a" can be favorably performed.

As shown in FIGS. 8 and 9, the load member 64 is provided with the inclined portion 646. When the end of the paper P on the upstream side in the paper feeding direction "a" floats apart from a contact position of the load member 64, the inclined surface of the inclined portion 646 suitably guides the end of the paper P on the upstream side in the paper feeding direction "a" to the center in the paper width direction.

The upper end of the inclined portion 646 continues to a non-inclined portion 647 which is parallel with the paper feeding direction "a" and with the vertical direction. The width of the non-inclined portion 647 in the paper feeding direction "a" is substantially the same as the width of the notch 633 in the paper feeding direction "a". The notch 633 is formed on the side surface portion 632 of the resistance force applying mechanism 63. The non-inclined portion 647 is stored inside the notch 633. The load member 64 moves vertically while slidably contacting with the side surface portion 632 in a state where the non-inclined portion 647 and the side surface portion 632 are arranged on substantially the same plane.

The tip of the guide plate 521 on the side edge regulating member 52 side is also fixed with the screws 533, 533. The resistance force applying mechanism 63 on the side edge regulating member 52 side is attached to the screws 533, 533 of the guide plate 521 in a state where the side surface portion 632 of the resistance force applying mechanism 63 on the side edge regulating member 52 faces with the side surface portion 632 of the resistance force applying mechanism 63 on the side edge regulating member 53 side.

Feeding Operation of Paper Feeding Device

The feeding operation by the paper feeding unit 50 with the above configuration will be described. A case in which the index paper is fed as paper P is exemplified (hereinafter referred to as index paper P). It is assumed that plural pieces of index paper P are fed and that index pieces P1 vary in position along the paper width direction "h".

As shown in FIG. 4, the index paper P is stacked on the paper stacking plate 51 in a state where every index piece P1 of the index paper P faces the upstream side in the paper feeding direction "a". At this time, the rear end regulating member 55 is aligned with the end of each index piece P1 on the upstream side in the paper feeding direction "a". The side edge regulating members 52, 53 are positioned such that they present the width of the index paper P. The auxiliary side edge regulating members 61, 62 are turned to be in the position not in use.

The through holes 631*b*, 631*b* are respectively aligned with the engagement protrusions 533*a*, 533*a* of the screws 533, 533 of the guide plates 521, 531, and the resistance force applying mechanisms 63, 63 are respectively attached to the side edge regulating members 52, 53. At this time, each of resistance force applying mechanism 63 is fixed to the upper surface of each of the guide plates 521, 531 by the magnet 637. The load member 64 is preliminarily mounted on the resistance force applying mechanism 63.

Using the control device of the image forming device 100, the lifting motor is driven and controlled in the lifting direction until the limit sensor detects that the height at the uppermost part of the index paper P stacked on the paper stacking plate 51 is at the upper limit stop position "m", and is stopped at the position where the uppermost index paper P is at the upper limit stop position "m".

As a result, the bottom of the inclined member 645 of the load member 64 of each of resistance force applying mechanisms 63 abuts on the upper surface of the uppermost index paper P, and the pressure is applied to generate the above-described appropriate load.

Next, in the paper feeding belt mechanism 56, each belt 563 turns into a state where each belt 563 can suck the paper, and the flotation air blowing units 57, 58 blow the flotation air from both sides in the paper width direction "h" to the uppermost index paper P. From the downstream side of the index paper P in the paper feeding direction "a", the air is blown obliquely downward to the uppermost index paper P by the separation air blowing unit 60 to float the index paper P.

As a result, plural pieces of index paper P including the uppermost index paper P start floating, and the uppermost index paper P is sucked to the lower part of the belt 563. At this time, the end of the uppermost index paper P on the upstream side in the paper feeding direction "a" is gradually guided to the center side by the inclined portion 646 of the inclined member 645. This straightens winding, if any, in the paper feeding direction "a".

After the flotation air is blown for a sufficient time to float the index paper P, the separation air blowing unit 60 switches the air blowing direction to obliquely upward and blows the separation air toward the tip of the floated uppermost index paper P.

At this time, the index paper P in which the index piece P1 does not abut on the rear end regulating member 55 is pushed to the upstream side in the paper feeding direction "a" by the separation air. However, at both edges of the end on the upstream side in the paper feeding direction "a", the load members 64 of resistance force applying mechanisms 63 press the index paper P to apply a load against movement. Thus, the movement to the upstream side in the paper feeding direction "a" is prevented.

Then, the separation air enters between the uppermost paper index paper P and the index paper P below the uppermost paper P to urge separation.

Then, the feeding of the belt 563 of the paper feeding belt mechanism 56 is started, and the uppermost index paper P is fed in the paper feeding direction "a". At this time, the end of the uppermost index paper P on the upstream side in the paper feeding direction "a", which is released from the pressure of each load member 64, is guided to the center side by the inclined portion 646 of the inclined member 645. If the uppermost index paper P is bent in relation to the paper feeding direction "a", the final correction is performed.

Then, the index paper P is conveyed to the conveyance unit 65 and further to the conveyance path of the image forming device body 100*a*, and image forming is performed.

Technical Effect of Embodiment of Invention

In the paper feeding device 500 of the above-described image forming device 100, the resistance force applying mechanism 63 of the paper feeding unit 50 contacts the end of the stacked upper index paper P on the upstream side in the paper feeding direction "a" with a pressure of the own weight of the load member 64 to apply a resistance force that gives a load against movement along the paper feeding direction "a". Therefore, the index paper P, which is below the uppermost index paper P and which is separated from the uppermost index paper P through air blowing of the separation air from the separation air blowing unit 60, is prevented from moving to the upstream side in the paper feeding direction "a". As a result, not only when the index piece P1 of the index paper P does not abut on the rear end regulating member 55, but also when the abutment is insufficient, the movement of the index paper P to the upstream side in the paper feeding direction "a" is suppressed. Thus, it is possible to avoid double feed or break of the index piece P1.

In the above-described resistance force applying mechanism 63, the load member 64 applies pressure from above to the end of the stacked uppermost index paper P on the upstream side in the paper feeding direction "a". Therefore, the resistance force against movement along with the paper feeding direction "a" can be applied with an easy configuration. Especially, in the resistance force applying mechanism 63, since the own weight of the load member 64 functions as the pressure, a member generating pressurizing force is not required, and the configuration can be simplified.

The resistance force applying mechanism 63 applies pressure to a certain range of the end of the uppermost index paper P on the upstream side in the paper feeding direction "a", the certain range being apart in the paper width direction "h", especially a part equal to or less than an eighth of the paper width from each of both ends. Therefore, it is possible to secure space through which the separation air passes from the end of the index paper P on the upstream side in the paper feeding direction "a", and to suppress the movement of the index paper P to the upstream side in the paper feeding direction "a" while the index paper P is separated appropriately.

Moreover, the resistance force applying mechanism 63 applies pressure to a range equal to or less than a fourth of the total length from the end of the index paper P on the upstream side in the paper feeding direction "a". Therefore, it is possible to suppress movement of the index paper P toward the upstream side in the paper feeding direction "a" while the resistance force applying mechanism 63 sufficiently reduces influence on the flotation of the end of the index paper P on the downstream side in the paper feeding direction "a".

Another Example of Resistance Force Applying Mechanism

Figure 13:
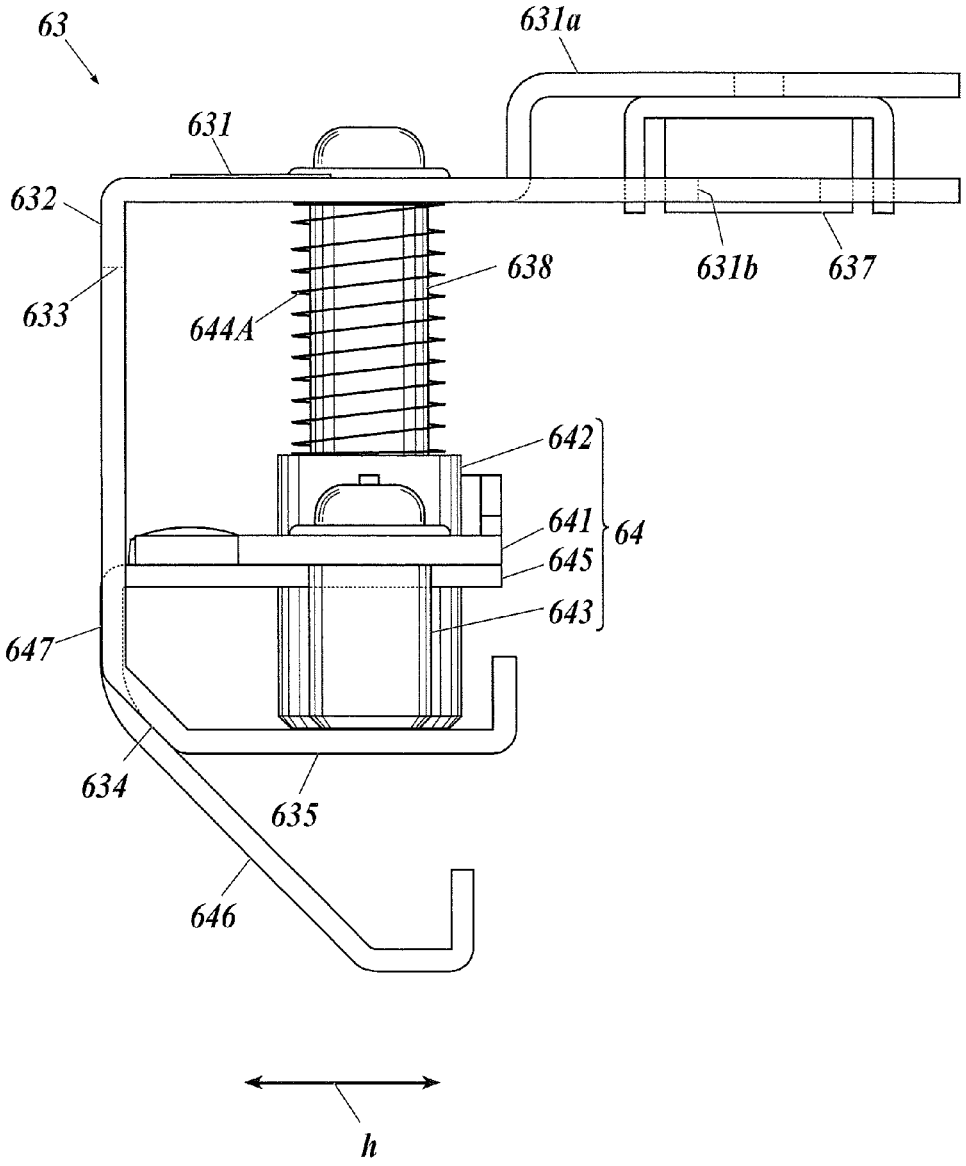
FIG. 13 is a rear view showing an example in which an elastic material is used for the resistance force applying mechanism.

In the above-described resistance force applying mechanism 63, the load member 64 is provided with the weight 644 and the own weight of the load member 64 applies pressure on the index paper P to give it a load. However, as shown in FIG. 13, a coil spring 644A which is an elastic member that presses the load member 64 downward may be used instead of the weight 644.

In that case, it is desirable to select a spring constant of the coil spring 644A such that the load by the coil spring 644A meets the above-described condition (A<W<B) of the load in FIG. 11 when the load member 64 abuts on the index paper P at the height of the upper limit stop position "m".

Figure 14:
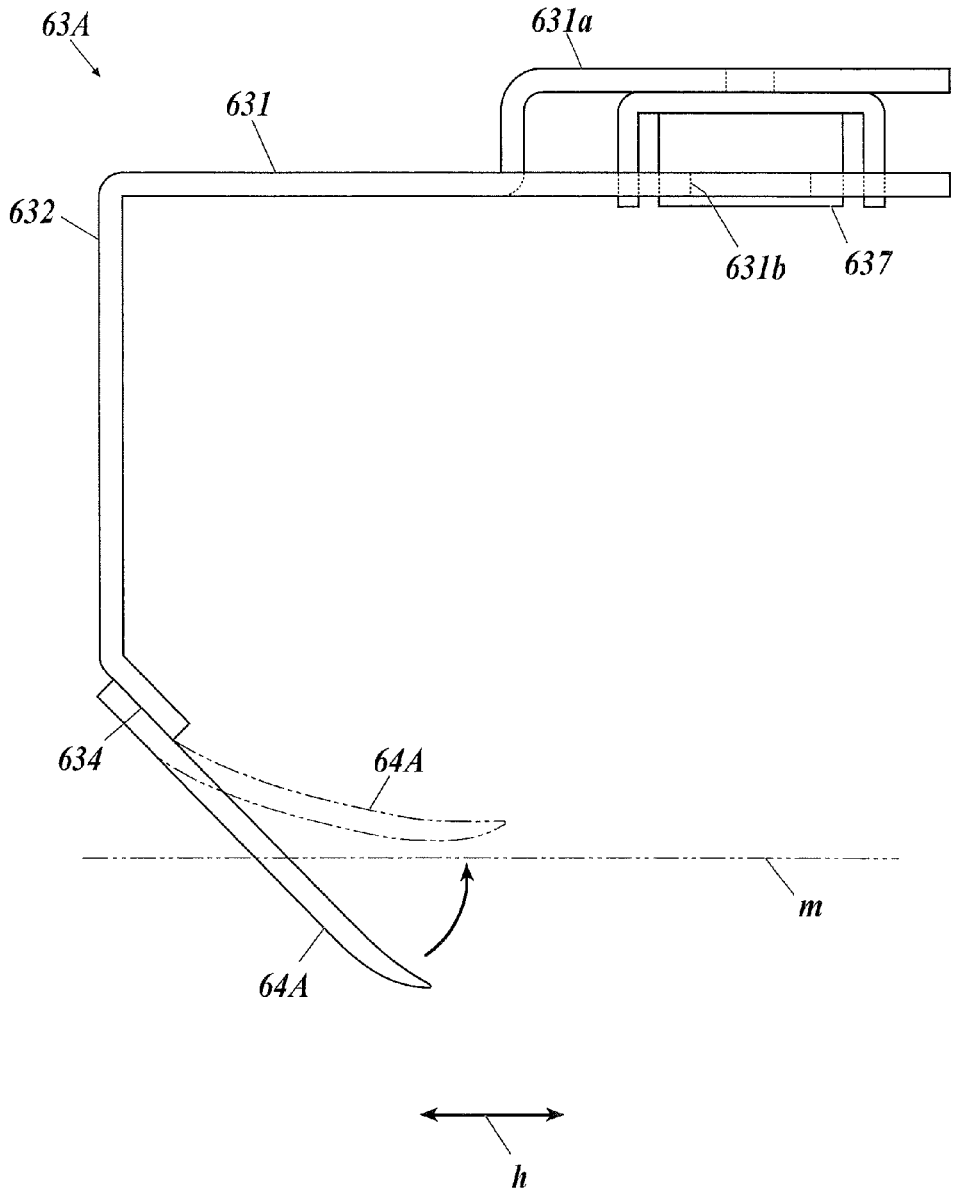
FIG. 14 is a rear view showing an example in which a sliding member is used for the resistance force applying mechanism.

Alternatively, as a resistance force applying mechanism 63A shown in FIG. 14, a flexible member 64A which has flexibility may be provided in the hanging state at the lower end of the inclined portion 634 instead of the load member 64 that is movable vertically. The flexible member 64A abuts on the uppermost index paper P while flexing its lower end, and the elastic force of the flexible member 64A which comes from flexibility gives the index paper P a load.

Also in this case, it is desirable to select the flexibility of the flexible member 64A such that the load that comes from the flexibility of the flexible member 64A meets the above-described condition (A<W<B) of the load in FIG. 11 when the flexible member 64A abuts on the index paper P at the height of the upper limit stop position "m".

Figure 15:
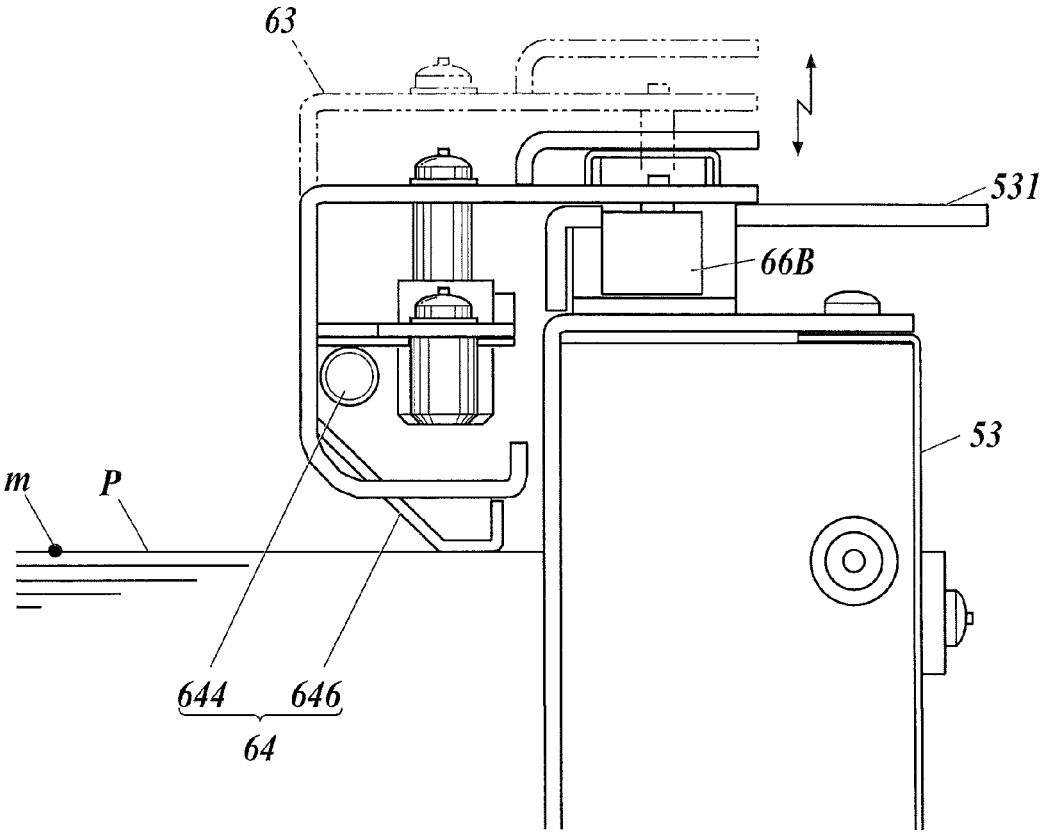
FIG. 15 is a rear view showing an example in which an actuator is mounted on the resistance force applying mechanism.
Figure 16:
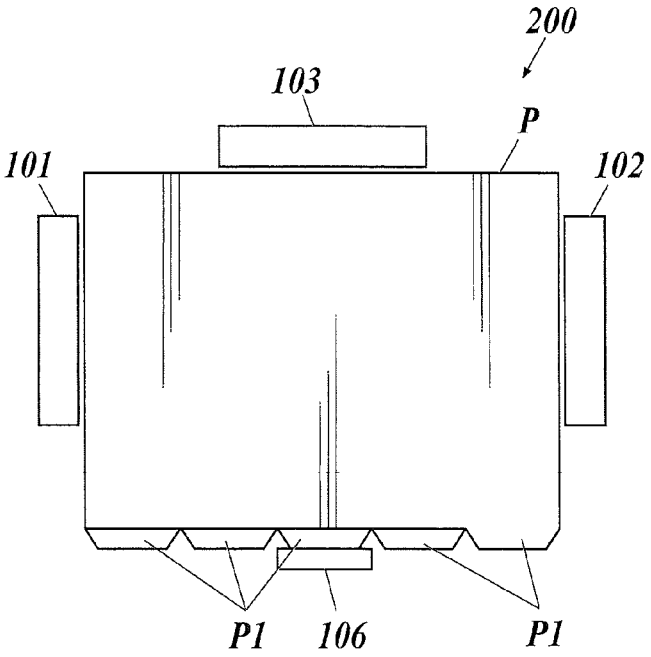
FIG. 16 is a schematic view showing a conventional paper feeding device.
Figure 17:
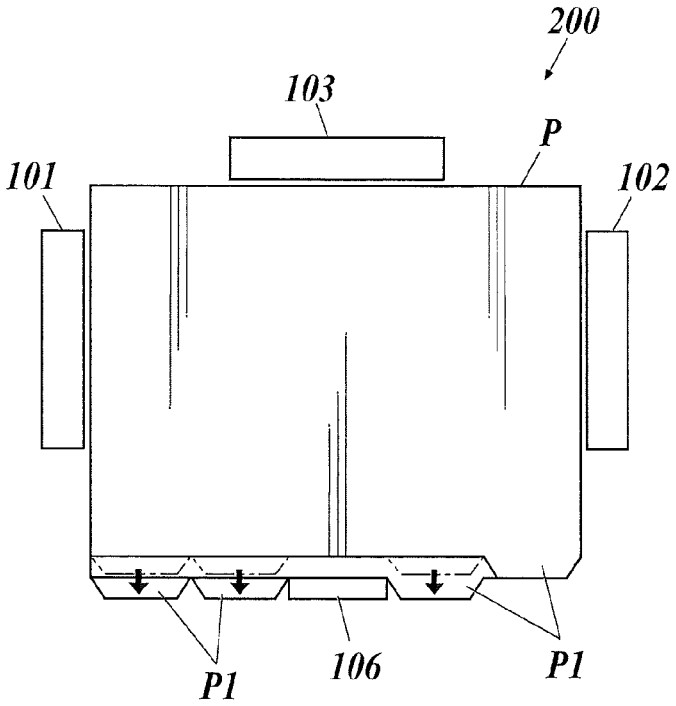
FIG. 17 is a schematic view showing a problem of the conventional paper feeding device.
Figure 18:
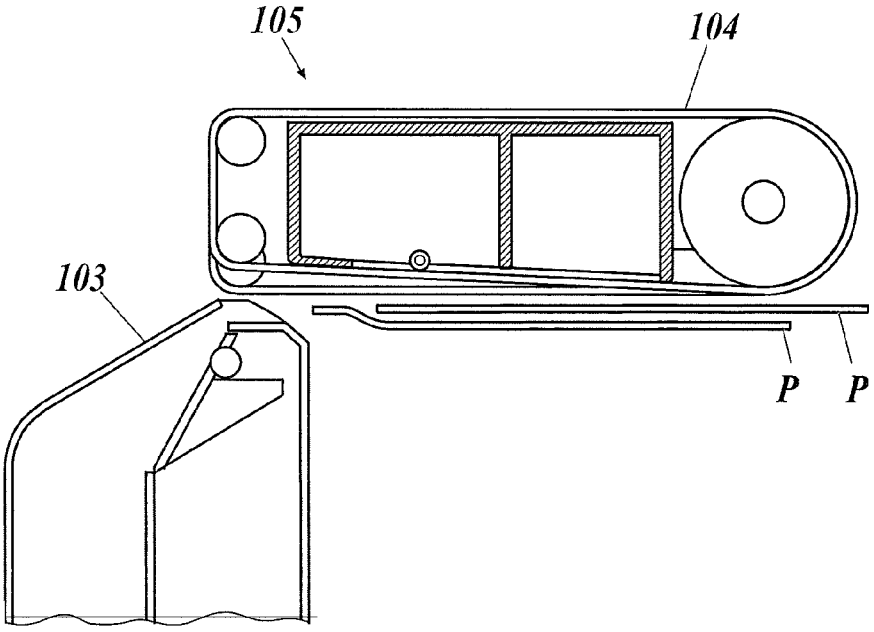
FIG. 18 is a side view showing the problem of the conventional paper feeding device.
Figure 19:
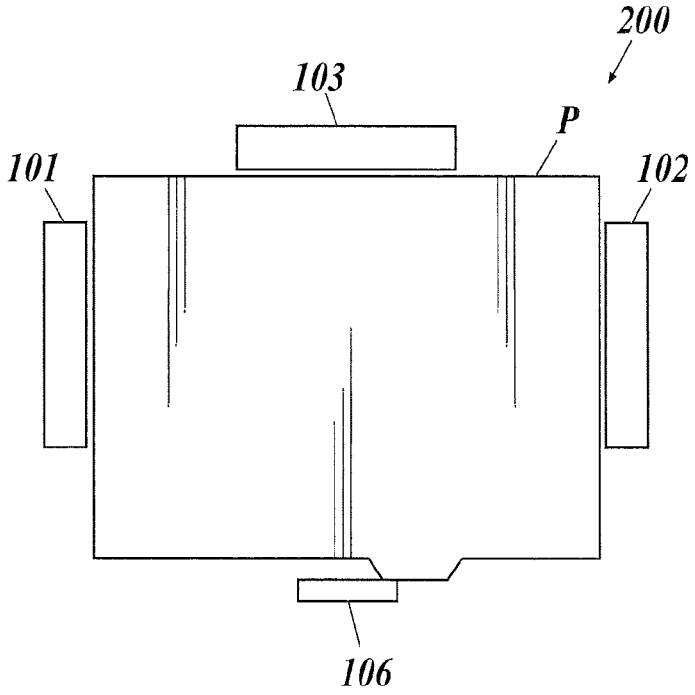
FIG. 19 is a schematic view showing the conventional paper feeding device.
Figure 20:
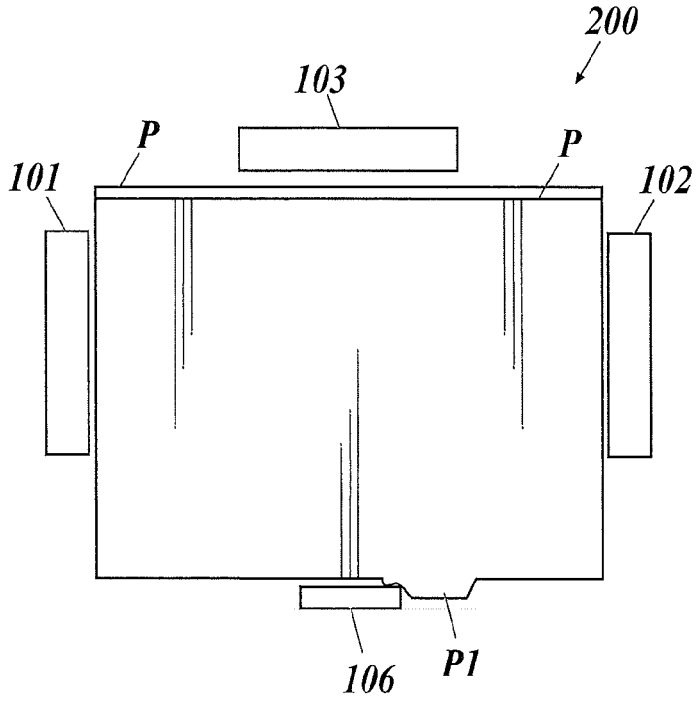
FIG. 20 is a schematic view showing a problem of the conventional paper feeding device.

Another Example of Resistance Force Applying Mechanism and Supporting Structure Thereof In the above example, the resistance force applying mechanism 63 is fixedly supported by the magnet 637 to the side edge regulating member 53 (or 52). However, as shown in FIG. 15, this magnet 637 may be removed, and the resistance force applying mechanism 63 may be supported by an actuator 66B which performs lifting and lowering operation and is provided on the side edge regulating member 53 (or 52) side so that the resistance force applying mechanism 63 can move vertically.

In this case, it is desirable to set each height such that the load member 64 gives the index paper P an appropriate load at the upper limit stop position "m" after the resistance force applying mechanism 63 is moved to the lowered position by the actuator 66B, and that the load member 64 does not reach the index paper P at the upper limit stop position "m" after the resistance force applying mechanism 63 is moved to the lifted position by the actuator 66B.

As a result, when the resistance force applying mechanism 63 is lowered by the actuator 66B, the resistance force applying mechanism 63 is turned into an operation state in use. When the resistance force applying mechanism 63 is lifted by the actuator 66B, the resistance force applying mechanism 63 is turned into a non-operation state not in use. Therefore, it is possible to realize the switching of these operation states with control of the actuator 66B.

The control device as a control unit of the image forming device 100 may be able to get into a control mode for the index paper in which specific control for using the index paper P as paper is performed. In this case, the following control may be performed. When execution of the control mode for the index paper is selected, the control device controls the above-described actuator 66B and automatically switch to an operation state where the resistance force applying mechanism 63 is used. When the control mode for the index paper is not executed, the control device controls to automatically switch to the non-operation state where the resistance force applying mechanism 63 is not used.

The specific control for using the index paper P includes, for example, control to inhibit paper inverting to avoid a state where the index piece P1 is on the front side while the paper is conveyed.

Others

In the above embodiment, the case where the paper feeding device 500 is mounted on an electrophotographic image forming device 100 is exemplified. However, the type of the image forming device is not limited to this. For example, the above-described paper feeding device 500 can be applied to any image forming device that forms image on paper with an ink jet system or others.

It is obvious that the present invention is not limited to the above-described embodiment and so on, and can be appropriately modified without departing from the scope of the present invention.

What is claimed is:

1. A paper feeding device of an image forming device for use with paper, the paper feeding device of the image forming device comprising:

a paper stacking plate on which the paper is stacked;

a flotation air blowing unit structured to float the stacked uppermost paper through air blowing;

a feeding mechanism structured to feed the floated uppermost paper in a paper feeding direction, wherein the flotation air blowing unit floats an end of the stacked uppermost paper, the end being on the downstream side in the paper feeding direction;

a separation air blowing unit structured to blow, toward the upstream side in the paper feeding direction, an end of other paper floated together with the floated uppermost paper to separate the other paper from the uppermost paper, the end being on the downstream side in the paper feeding direction;

a rear end regulating member which abuts on an end of the stacked paper to regulate a position of the end, the end being on the upstream side in the paper feeding direction; and a load member structured to press the upstream side in the paper feeding direction of the stacked uppermost paper, wherein the load member is structured to prevent a movement of the paper by a blowing of the separation air blowing unit from the downstream side in the paper feeding direction to the upstream side in the paper feeding direction, and the load member is spaced apart from the rear end regulating member, wherein the load member is structured to apply pressure from above to the end of the stacked uppermost paper, the end being on the upstream side in the paper feeding direction, wherein the load member comprises a flexible member which contacts with the uppermost paper, and wherein flexibility of the flexible member applies pressure to the uppermost paper.

2. The paper feeding device of the image forming device according to claim 1, wherein the load member is structured to apply pressure to a certain range of the end of the stacked uppermost paper on the upstream side in the paper feeding direction, the certain range being a part in the paper width direction perpendicular to the paper feeding direction.

3. The paper feeding device of the image forming device according to claim 2, wherein the load member is structured to apply pressure to portions of the end of the stacked uppermost paper on the upstream side in the paper feeding direction, the portions being both ends in the paper width direction.

4. The paper feeding device of the image forming device according to claim 3, wherein the load member is structured to apply pressure to each of the both ends in the paper width direction in a range equal to or less than an eighth of a total width from each end of the paper.

5. The paper feeding device of the image forming device according to claim 1, wherein the load member is structured to apply pressure to a certain range from the end of the paper on the upstream side in the paper feeding direction, the certain range being equal to or less than a fourth of a total length in the paper feeding direction.

6. The paper feeding device of the image forming device according to claim 1, wherein the load member comprises a pressurizing member, and wherein the own weight of the pressurizing member applies pressure to the upper paper.

7. The paper feeding device of the image forming device according to claim 6, wherein a value of the load by the load member is between a first value and a second value; and wherein the first value corresponds to a value of the load at which the paper is moved to the upstream side in the paper feeding direction by the separation air when a paper pressing force is no more than the value; and the second value corresponds to another value of the load at which the feeding mechanism cannot feed the paper when the paper pressing force reaches the another value.

8. The paper feeding device of the image forming device according to claim 1, wherein the load member comprises an elastic member, and wherein elastic force of the elastic member applies pressure to the upper paper.

9. The paper feeding device of the image forming device according to claim 1, comprising a lifting drive unit structured to lift the paper stacking plate to a position where the stacked uppermost paper is at a certain upper limit stop position;

wherein the load member is structured to apply the resistance force when the uppermost paper is at the upper limit stop position.

10. The paper feeding device of the image forming device according to claim 1, comprising a pair of side edge regulating members which abuts on both ends of the stacked paper in the paper width direction perpendicular to the paper feeding direction and regulates positions of the ends;

wherein the load member is individually and detachably provided on each of the pair of side edge regulating members.

11. The paper feeding device of the image forming device according to claim 1, wherein the load member comprises an inclined surface structured to guide the end of the paper on the upstream side in the paper feeding direction such that the end of the paper does not bend in relation to the paper feeding direction.

12. An image forming device which comprises the paper feeding device according to claim 1.

13. The image forming device according to claim 12, further comprising a control unit structured to execute specific control for using index paper as the paper, wherein the load member comprises an actuator structured to switch between an operation state in which the upstream side in the paper feeding direction of the stacked uppermost paper is pressed, and a non-operation state in which the upstream side in the paper feeding direction of the stacked uppermost paper is not pressed, and wherein the control unit is structured to control the actuator such that, when the specific control is executed, the load member is in the operation state.

14. The paper feeding device of the image forming device according to claim 1, wherein the load member is structured to press the upstream side in the paper feeding direction of the stacked uppermost paper so that a plurality of the stacked papers contact each other.

15. The paper feeding device of the image forming device according to claim 1, wherein the paper is an index paper comprising a tab; and wherein the rear end regulating member is structured to regulate a position of a tab side of the index paper.

16. The paper feeding device of the image forming device according to claim 1, wherein the separation air blowing unit is structured to blow, in response to pressing of the upstream side in the paper feeding direction of the stacked uppermost paper by the load member.

17. A paper feeding device of an image forming device for use with paper, the paper feeding device of the image forming device comprising:

a paper stacking plate on which the paper is stacked;

a lifting drive unit structured to lift the paper stacking plate to a position where stacked uppermost paper is at a certain upper limit stop position;

a flotation air blowing unit structured to float the stacked uppermost paper through air blowing;

a feeding mechanism structured to feed the floated uppermost paper in the paper feeding direction, wherein the flotation air blowing unit floats an end of the stacked uppermost paper, the end being on the downstream side in the paper feeding direction;

a separation air blowing unit structured to blow, toward the upstream side in the paper feeding direction, and end of other paper floated together with the floated uppermost paper to separate the other paper from the uppermost paper, the end being on the downstream side in the paper feeding direction;

a rear end regulating member which abuts on an end of the stacked paper to regulate a position of the end, the end being on the upstream side in the paper feeding direction, and a load member structured to apply resistance force that gives a load against movement along the paper feeding direction to an end of stacked upper paper, the end being on the upstream side in the paper feeding direction, wherein the load member is structured to apply pressure from above to the end of the stacked uppermost paper, the end being on the upstream side in the paper feeding direction, and wherein the load member comprises a flexible member which contacts with the uppermost paper; and flexibility of the flexible member applies pressure to the uppermost paper.

* * * * *